US005760797A

United States Patent [19]

Koizumi et al.

[11] Patent Number: 5,760,797

[45] Date of Patent: Jun. 2, 1998

[54] INK JET RECORDING HEAD WITH ADJUSTABLE TEMPERATURE SENSOR AND INK JET RECORDING SYSTEM HAVING THE SAME

[75] Inventors: Ryoichi Koizumi; Asao Saito; Yoshiaki Takayanagi, all of Yokohama, Japan

[73] Assignee: Canon Kabushiki Kaisha, Tokyo, Japan

[21] Appl. No.: 288,703

[22] Filed: Aug. 12, 1994

Related U.S. Application Data

[63] Continuation of Ser. No. 953,773, Sep. 30, 1992, abandoned, which is a continuation of Ser. No. 584,925, Sep. 18, 1990, abandoned.

[30] Foreign Application Priority Data

Sep. 18, 1989 [JP] Japan ..... 1-241027
Oct. 27, 1989 [JP] Japan ..... 1-280166

[51] Int. Cl.[6] ..... B41J 2/05

[52] U.S. Cl. ..... 347/14; 347/17; 347/19; 347/59

[58] Field of Search ..... 347/14, 17, 19, 347/57, 59, 189, 191, 194; 374/178, 1; 257/48, 470, 467

[56] References Cited

U.S. PATENT DOCUMENTS

| | | | |
|---|---|---|---|
| 3,880,006 | 4/1975 | Poduje | 374/173 |
| 4,122,719 | 10/1978 | Carlson | 374/172 X |
| 4,161,880 | 7/1979 | Prosky . | |
| 4,313,124 | 1/1982 | Hara . | |
| 4,345,262 | 8/1982 | Shirato et al. . | |
| 4,396,923 | 8/1983 | Noda | 346/76 PH |
| 4,443,117 | 4/1984 | Muramoto | 347/1 |
| 4,459,600 | 7/1984 | Sato et al. . | |
| 4,463,359 | 7/1984 | Ayata et al. . | |
| 4,481,596 | 11/1984 | Townzen | 374/172 X |
| 4,531,842 | 7/1985 | Schonberger | 347/1 |
| 4,558,333 | 12/1985 | Sugitani et al. . | |
| 4,704,618 | 11/1987 | Gotoh | 347/194 X |
| 4,723,129 | 2/1988 | Endo et al. . | |
| 4,740,796 | 4/1988 | Endo et al. . | |
| 4,860,034 | 8/1989 | Watanabe | 347/14 |
| 4,910,528 | 3/1990 | Firl | 347/17 |
| 5,039,237 | 8/1991 | Tanuma | 400/178 X |
| 5,049,898 | 9/1991 | Arthur | 347/19 |
| 5,107,276 | 4/1992 | Kneezel | 347/17 |
| 5,175,565 | 12/1992 | Ishinaga | 347/17 |
| 5,485,182 | 1/1996 | Takayanagi | 347/17 |

FOREIGN PATENT DOCUMENTS

| | | | |
|---|---|---|---|
| 57-72867 | 5/1982 | Japan . | |
| 59-123670 | 7/1984 | Japan . | |
| 59-138461 | 8/1984 | Japan . | |
| 63-257648 | 10/1988 | Japan | B41J 3/04 |

OTHER PUBLICATIONS

Lonis, Robert A.; Storage of Operating Parameters in Memory Integral with Printhead; Xerox Disc. Journal, v8, N6 Nov./Dec. 1983, p. 503.

*Primary Examiner*—Joseph W. Hartary
*Attorney, Agent, or Firm*—Fitzpatrick, Cella, Harper & Scinto

[57] ABSTRACT

An ink jet recording head includes an ink discharging portion having a discharge opening for discharging ink, a substrate having an electrical/thermal converting element for generating thermal energy supplied to the ink discharging portion and used to discharge the ink, and a temperature detecting element, and an information bearing means for carrying information providing the feature of the temperature detecting element. The output from the temperature detecting element are used to adjust the temperature of the ink jet recording head.

27 Claims, 23 Drawing Sheets

FIG. 9

| RANK | $V_F$ OF SENSOR [V] (25℃) | a | b | c |
|---|---|---|---|---|
| 1 | 0.575 ~ 0.579 | | | |
| 2 | 0.570 ~ 0.574 | | | ○ |
| 3 | 0.565 ~ 0.569 | | ○ | |
| 4 | 0.560 ~ 0.564 | | ○ | ○ |
| 5 | 0.555 ~ 0.559 | ○ | | |
| 6 | 0.550 ~ 0.554 | ○ | | ○ |
| 7 | 0.545 ~ 0.549 | ○ | ○ | |
| 8 | 0.540 ~ 0.544 | ○ | ○ | ○ |

○ ~ BIT TO BE BORED

INK JET RECORDING HEAD WITH ADJUSTABLE TEMPERATURE SENSOR AND INK JET RECORDING SYSTEM HAVING THE SAME

This application is a continuation of application Ser. No. 07/953,773 filed Sep. 30, 1992, now abandoned and which is a continuation of application Ser. No. 07/584,925 filed Sep. 18, 1990, now abandoned.

BACKGROUND OF THE INVENTION

Field of the Invention

The present invention relates to an ink jet recording head and an ink jet recording system having such head, which are used with a copying machine, facsimile, word processor, output printer of a host computer, video output printer and the like, and more particularly, it relates to an ink jet recording head and an ink jet recording system having such head, wherein electrical/thermal converting elements and functional elements are disposed on a common substrate.

The present invention further relates to a temperature adjusting apparatus used with a recording system, and, more particularly, it relates to a temperature adjusting apparatus which includes a plurality of similar analogue sensors for detecting the surrounding condition (for example, temperature) and wherein the surrounding condition is measured by receiving the outputs from such sensors through an amplifying circuit to adjust the temperature of a recording head of the recording system.

Related Background Art

There has been proposed a recording head wherein an array of electrical/thermal converting elements is formed on a single crystal silicon substrate, functional elements such as an array of transistors for activating the electrical/thermal converting elements are arranged outside the substrate, and the electrical/thermal converting elements are connected to the transistor array through a flexible cable, wire bonding and the like.

In order to simplify the construction of the above-mentioned recording head, to reduce the number of bad parts in the head production line, and to improve the uniformity and/or reemergence of the features of various elements, an ink jet recording system having a recording head wherein electrical/thermal converting elements and functional elements are arranged on the same substrate has been proposed, as disclosed for example in the Japanese Patent Laid-open No. 57-72867.

Although the above-mentioned recording head is excellent, there is a room for further improving the recording head and the recording system to meet the requirements regarding higher speed of operation, lower energy consumption, better integration, cost decreases and/or higher reliability strongly requested in the recent recording systems.

In order to gain success in the commercial base, a recording head having a high level of performance must be provided with a low cost. To this end, it is necessary to provide an inexpensive recording head wherein the functional elements are integrated with high density, an area of a chip forming the substrate of the recording head is reduced, and a number of substrate 8 can be obtained from a single wafer.

This can be referred to regarding not only a driving circuit but also various elements (typically, a temperature sensor) for performing good recording.

In the above-mentioned ink jet recording head, the recording is effected by discharging the liquid such as ink by the use of thermal energy generated from the electrical/thermal converting elements including heating resistive members. When such recording head is activated, the temperature of the recording head is gradually increased as the recording operation is continued due to the fact that a part of the-thermal energy generated is accumulated in the liquid and due to other reasons.

The increase in the temperature of the recording head affects a bad influence upon the viscosity of the ink, generation and growth of the bubble and the like, thus changing the amount of the discharged ink, and accordingly, the diameter of dots recorded on a recording medium. This results in the deterioration of the image quality, which should be avoided.

To the contrary, a recording factor control for decreasing the temperature of the recording head on the basis of the detected temperature of the recording head (for example, a control effected by stopping the recording operation or by using a Peltier element) has been proposed in the past. In order to obtain the parameters for the above control, a temperature detecting element acting as a means for detecting the temperature of the recording head was provided for giving the output information for effecting such control. One example is shown in FIG. 1 illustrating a schematic perspective view of a recording head 10'.

As is apparent from FIG. 1, electrical/thermal converting elements are formed at an end of a semiconductor substrate 51, and a top plate 52 including a liquid chamber therein is disposed on the substrate to define orifices 53. A temperature detecting portion is arranged on a mother board 54 at 60 or on the semi-conductor substrate 51 at 70. Concrete examples of the temperature detecting portion are shown in FIGS. 2A and 2B.

FIG. 2A shows an example wherein a thermistor 61 acting as a temperature sensor is mounted on the mother board 54. In this arrangement, it should be noted that the disadvantage will arise regarding the number of parts, and thus, in the production line since the thermistor 61 must be added as a discrete element.

On the other hand, FIG. 2B shows an example wherein a diode 71 having the P-N connection is formed on the semiconductor substrate 51 made of single crystal silicon material by the semiconductor process and a temperature sensor is provided by the use of the diode feature. That is to say, it is possible to achieve the higher functionality, higher integration and cost decreases by forming the temperature sensor, by means of the semiconductor process, on the substrate on which the electrical/thermal converting elements are disposed. Incidentally, the reference numeral 72 denotes an aluminium electrode, and 73 denotes an insulator layer made of $SiO_2$.

Although the recording heads can be manufactured in the same production line, dispersion in ink discharging features of the recording heads will occur. In order to correct or compensate such dispersion, a method wherein the information corresponding to the electrical/thermal converting features of the electrical/thermal converting elements, and thus, the discharging feature is previously formed on the recording head, for example in the form of electric resistors, and the recording head is driven by determining the discharging signal as the recording factor on the basis of such information has been proposed.

However, even if such method is used, under the irregular or non-uniform usage of the recording head, the poor discharge of ink will occur, thus worsening the image quality. Particularly, it was found that the deterioration of the image quality occurs noticeably in the recording systems having a high level of performance wherein the recording is effected while adjusting the temperature of the recording head.

As a result of a number of tests and experiments repeatedly performed by the inventors of this invention, it was found that such deterioration of the image quality mainly depends upon the change in temperature dependence of the detection output due to the dispersion in the inherent features of the temperature sensors themselves for the recording head, rather than the time-to-time change or the environment dependence of the electrical/thermal converting feature. However, this problem cannot be solved easily.

That is to say, in the substrate for the recording head using an ink jet recording method, for example as disclosed in U.S. Pat. No. 4,723,129 (Endo et al), the electrical/thermal converting elements capable of generating the thermal energy enough to cause the change in the condition of the ink and to discharge the ink from a discharge opening must be formed or provided. On the other hand, since the functional elements for driving the recording head and for detecting the temperature of the head, such as diodes, transistors and the like have the features depending upon the change in temperature (i.e., temperature dependence features), these must be activated under the temperature condition which is stable as long as possible.

In other words, in order to arrange two kinds of elements having incompatible inherent features on the same substrate (the meaning of the words "on the substrate" also includes the case where the functional elements are formed in the substrate) and to activate these elements properly, unique constructions or arrangements of a recording head and a recording system must be devised under a new conception. Of course, it is also requested that such constructions be provided in an inexpensive manner.

Now, FIG. 3 shows an example of a conventional measuring device for measuring the surrounding (environmental) condition, such as for example, a temperature. In FIG. 3, the reference numerals D denotes a diode acting as a temperature detecting sensor; Al, A2 denote amplifiers; C denotes a CPU forming a main portion of the measuring device. In this way, when the input level from the diode D which is an analogue sensor is measured, conventionally, it was practical that the output from the sensor was level-changed by means of the amplifiers (A1, A2); in this case, the error inherent to the circuit itself, i.e., the error derived from the offset voltages of the amplifiers and/or the rated error of the circuit elements was adjusted or compensated by variable resistors (VR1, VR2) of the amplifiers. That is to say, as shown in FIG. 4, with respect to the feature of temperature T-output value V of an ideal amplifier, a circuit error such as ΔT will occur in effect. Thus, when the outputs of the amplifiers at a reference temperature T0 have values as A and B, these values are adjusted to have a value of V0 by means of the variable resistors (volume).

However, in such a conventional example, although, if a number of systems (detection systems) each comprising the sensor and the amplifiers (i.e., a number of positions to be adjusted) is small, the production cost and/or the adjusting time are not badly influenced, such problem will become gradually noticeable as the number of such systems increases.

SUMMARY OF THE INVENTION

An object of the present invention is to solve the above-mentioned conventional drawbacks and to provide a recording head and a recording system having high ability, which can perform recording at a high speed with high resolution stable for a long time.

Another object of the present invention is to provide an inexpensive recording head wherein electrical/thermal converting elements and functional elements are disposed on the same substrate, and an inexpensive recording system having a temperature adjusting function of high ability.

A further object of the present invention is to provide a recording system and a temperature adjusting apparatus which can perform the temperature adjustment properly without increasing the manufacturing cost and/or the dimension thereof and without lengthening the adjustment time, even if the number of the above-mentioned systems is increased.

A still further object of the present invention is to provide an ink jet recording head comprising an ink discharging portion having a discharge opening for discharging ink; a substrate having an electrical/thermal converting element for generating thermal energy supplied to the ink discharging portion and used to discharge the ink, and a temperature detecting element; and an information bearing means for carrying information providing the feature of the temperature detecting element.

Another object of the present invention is to provide an ink jet recording system comprising an ink jet recording head used for forming a desired image on a recording medium by discharging ink from a discharge opening in response to a predetermined input signal; and a drive controlling means for controlling an operation of the ink jet recording head. It further comprises a temperature adjusting means having a detecting system including a detecting element for detecting the environmental condition surrounding the ink jet recording system, a memory means for storing an output value from the detecting system regarding an output of the detecting element as a reference or the result obtained by performing a predetermined calculation with respect to the output value, and a correcting means for correcting an error of the detecting system on the basis of the contents stored-in the memory means.

According to the present invention, since the pattern acting as the information bearing means for bearing or carrying the information providing the feature of the temperature detecting element is previously formed on the recording head, it is possible to correct the dispersion in the temperature detecting elements obtained by the semiconductor process, with a very simple method and arrangement, and to perform the proper temperature control.

Further, in the present invention, for the purpose of the recognition of the error AV conventionally adjusted by the volume, the data representing the characteristics of the circuit such as the value ΔV, V value at the point A and the like are stored in the memory means comprising an involatile memory and the correction of the measured values is effected on the basis of the contents stored in the memory.

With this arrangement, according to the present invention, since the reference value is previously set as the output of the detecting element, and the output value of the detecting system or the result obtained by performing the predetermined calculation using such output value is stored in the memory means, the error in the detecting system used is corrected on the basis of the contents stored in the memory means, when the control is effected in accordance with the environmental condition. Thus, it is possible to obtain the measurement result with high accuracy and to perform the proper temperature adjustment, without adjusting the rated error of the detecting element and/or the output voltage level regarding the offset voltage of the amplifying circuits.

BRIEF DESCRIPTION OF THE DRAWINGS

FIG. 9 is a table showing an example of a method for ranking the temperature sensors, according to the present invention;

DESCRIPTION OF THE PREFERRED EMBODIMENTS

The present invention will now be explained in connection with embodiments thereof with reference to the accompanying drawings. However, the present invention is not limited to such embodiments, but may be as any types which can achieve the objects of the invention.

Embodiment 1

First of all, a temperature feature of a diode acting as a temperature detecting element applicable to the present invention will be described.

Figure 1:
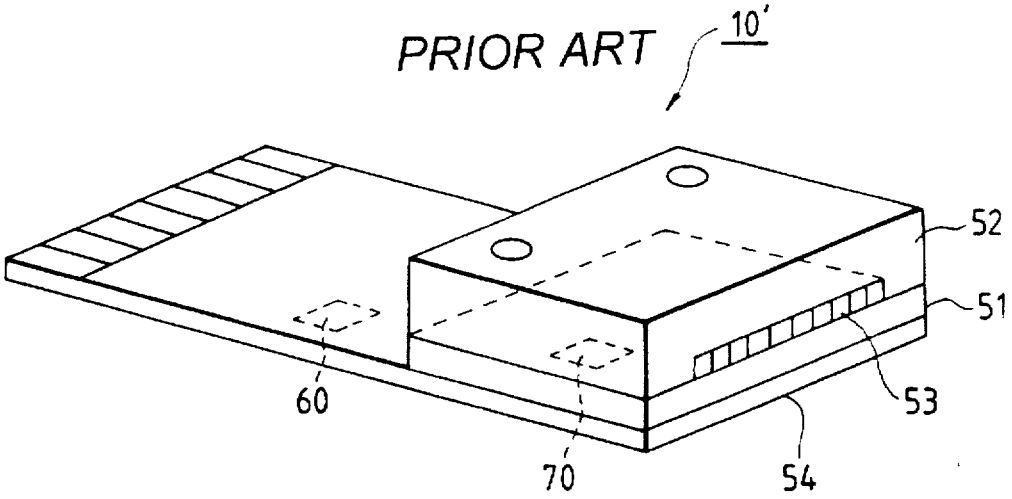
FIG. 1 PRIOR ART
FIG. 1 is a schematic perspective view of an ink jet recording head with a temperature sensor.
Figure 2A:
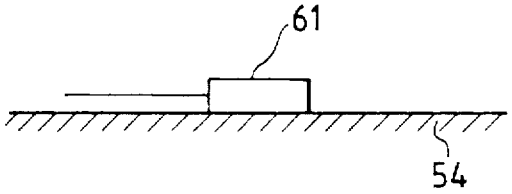
FIG. 2A PRIOR ART
FIGS. 2A and 2B are sectional view for explaining the temperature sensor.
Figure 2B:
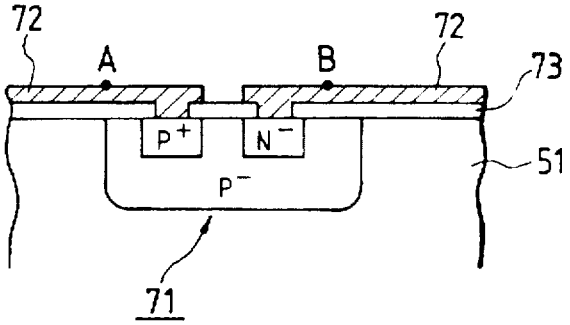
FIG. 2B PRIOR ART
Figure 3:
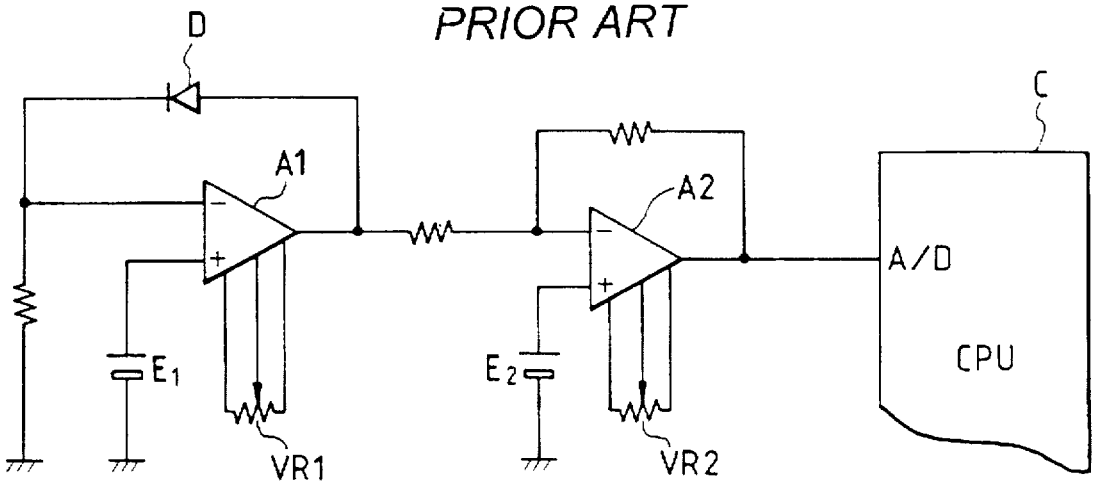
FIG. 3 PRIOR ART
FIG. 3 is a circuit diagram showing a conventional environmental condition measuring device.
Figure 4:
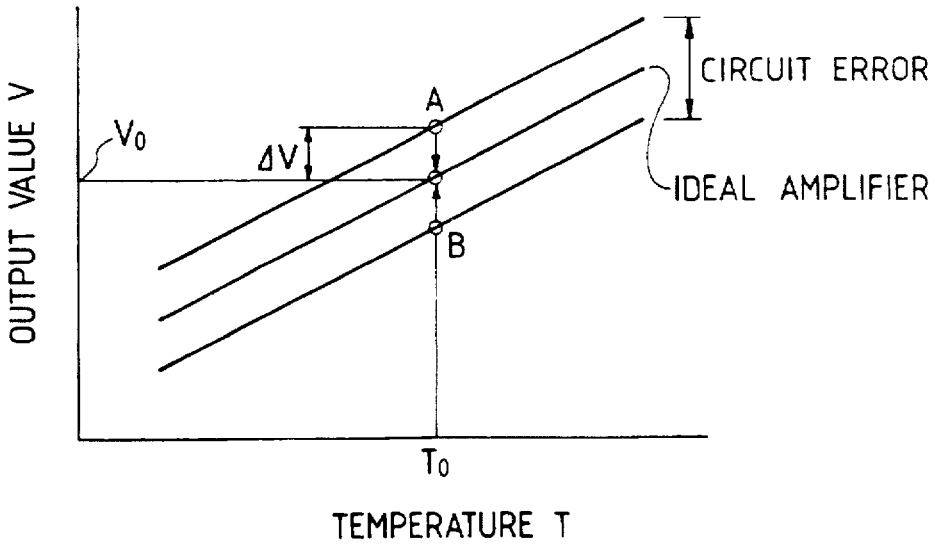
FIG. 4 PRIOR ART
FIG. 4 is a graph for explaining an operation of the device of FIG. 3.
Figure 5A:
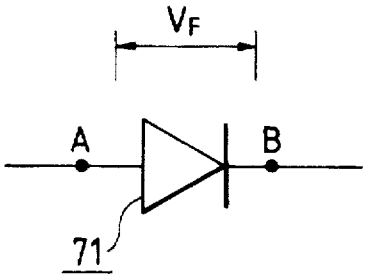
FIGS. 5A and 5B are schematic views for explaining a diode sensor.

FIG. 5A shows an equivalent circuit for a diode. In FIG. 5A, when a current flows from a direction A to a direction B, a voltage reduction $V_F$ is created in a normal direction of the diode 71. In general, the voltage reduction $V_F$ in the normal direction varies in response to the change in the temperature. Thus, it is possible to detect the temperature by the use of such change in the voltages.

Further, the voltage reduction $V_F$ also varies in accordance with the density of current flowing in the diode. If the current is maintained at a constant value, the voltage reduction detected in the diode 71 in the normal direction will be determined only as a function of the temperature. That is to say, the relationship between the voltage reduction $V_F$ and the temperature will be expressed by the following equation (1):

$$V_F \alpha KT/q \ \ln(I_F/I_s) \tag{1}$$

Where, K and q are constants referred to as "wave number" and "charge of electron", respectively. Further, $I_s$ is a given current constant derived from the area of the P-N connection, $I_F$ is a current value in the normal direction, and T is an absolute temperature.

Accordingly, if the current value $I_F$ in the normal direction flowing in the diode is fixed, the voltage $V_F$ in the normal direction can be expressed only as a function of the absolute temperature T. That is to say, the following relationship is given:

$$V_F \alpha \sigma_T$$

where, $$\sigma = K/q \ \ln(I_F/I_S) \tag{2}$$

Figure 5B:
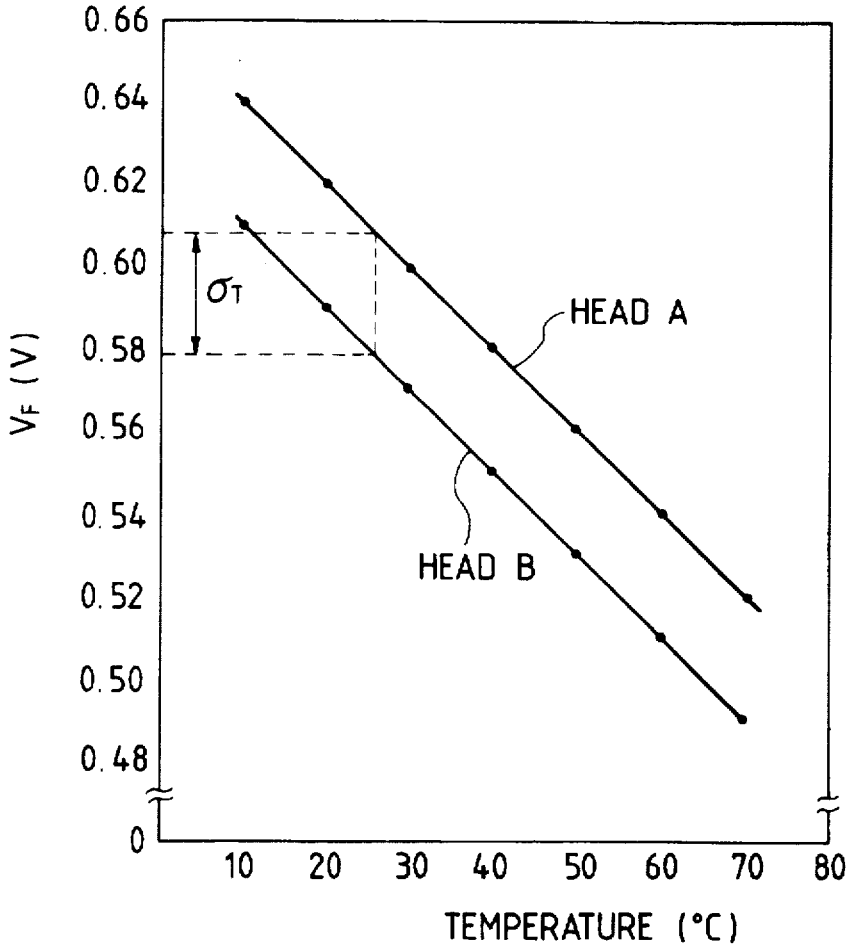

FIG. 5B is a graph showing the measurement result presenting the relationship given by the expression (2).

As apparent from this graph, the values of $V_F$ is dispersed due to the dispersion derived from the diode production or manufacturing line. According to FIG. 5B, in a recording head B manufactured in the same production line as a certain recording head A, the dispersion of 30 mV will occur at a temperature of 25° C. ($\sigma_T$). Converting this into the temperature, a detection error of 15° C. will occur. If these two recording heads are used to be driven under the same condition, it will be impossible to detect the correct temperature, thus providing the insufficient power at the lower temperature, which causes the poor ink discharging and/or overheating of the recording head due to the inadequate control at the higher temperature, which causes the deterioration of the image quality. Further, the service life of the recording heads will be shortened.

According to this example, since the information bearing means for carrying the dispersion information of the diodes is disposed on a wiring substrate integrally fixed to a semiconductor substrate on which the temperature detecting diode is arranged, the dispersion information inherent to the recording head is detected in a main body side, thereby permitting the correct temperature control.

Figure 6:
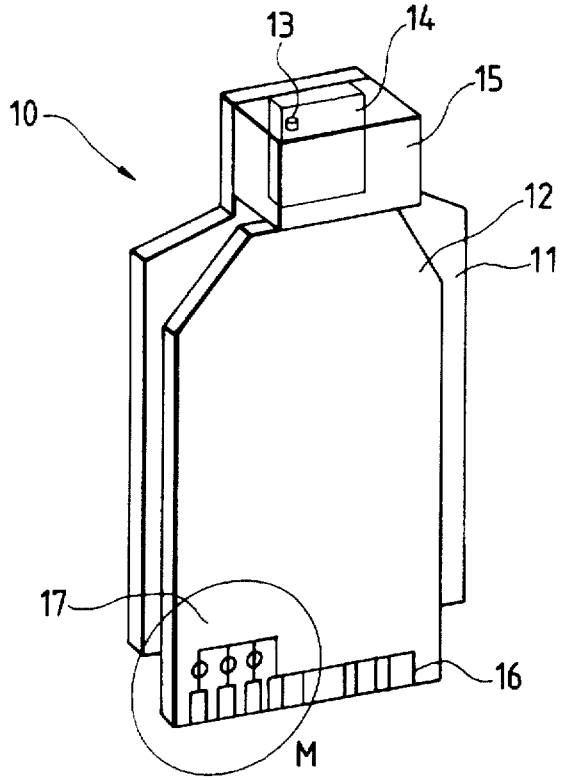
FIG. 6 is a schematic perspective view of an ink jet recording head according to an embodiment of the present invention.

FIG. 6 is a schematic perspective view of a recording head according to an embodiment of the present invention.

The recording head 10 is constituted by a substrate 14 arranged on an aluminium base plate 11 and on which a temperature detecting sensor 13 is formed, a top plate 15 including a liquid chamber therein and disposed on the substrate, and a PCB plate 12 on which the wirings extending from the substrate 14 to an electric connector portion 16 are disposed. Further, on the PCB plate 12, a sensor rank detecting pattern 17 acting as an information bearing means is formed. The substrate 14 is electrically connected to the PCB plate 12 by a bonding wire and the like (not shown), and further, the plate is electrically connected to a main body of a printer through the electric connector portion 16 so that the head 10 is driven by a drive controlling circuit arranged in the main body side.

Figure 7:
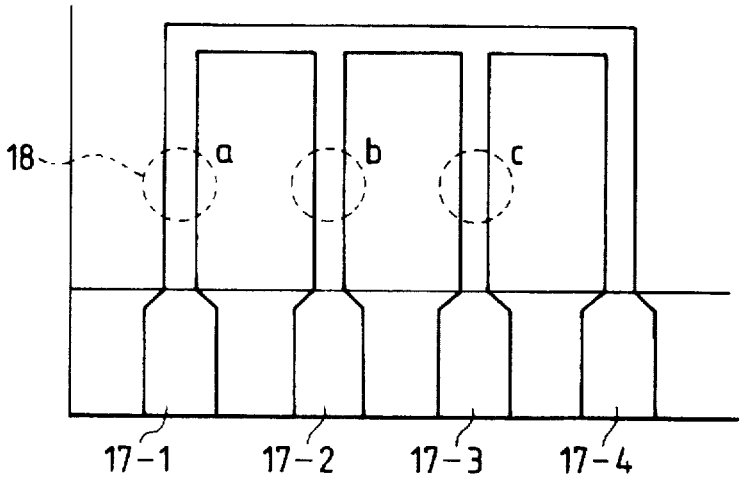
FIG. 7 is an enlarged view showing the details in a portion M in FIG. 6.

FIG. 7 shows a portion of the sensor rank detecting pattern 17 of FIG. 6 in an enlarged scale. In the illustrated example, four patterns 17-1, 17-2, 17-3 and 17-4 are used. Portions 18 to be bored correspond to three areas a, b and c encircled by broken line circles. The pattern 17-4 is electrically earthed when the recording head is mounted on the recording system. By selectively boring the portions a, b, c, the bearing means for carrying the ranking information is provided. Further, by electrically or optically reading the selectively opened or short-circuited pattern, it is possible to rank the temperature sensor. In the illustrated example, the ranking for three bits, i.e., the ranking into eight ranks will be fully explained.

Figure 8:
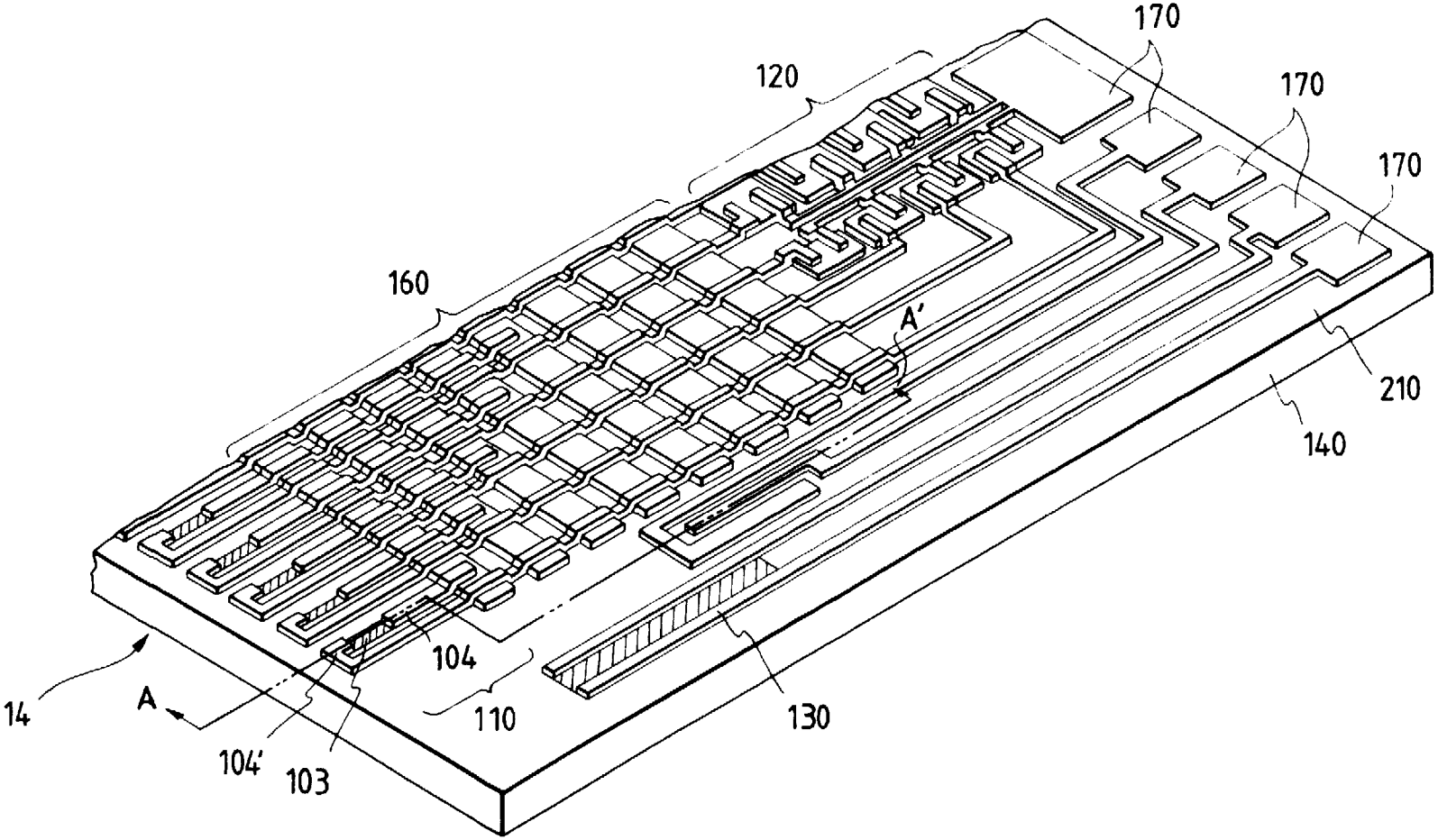
FIG. 8 is a schematic perspective view of a substrate of the ink jet recording head according to the present invention.

FIG. 8 is a schematic perspective view for explaining the substrate 14 of FIG. 6.

In FIG. 8, the reference numeral 110 denotes electrical/thermal converting elements which are is formed on a semiconductor substrate 140 by a process which will be described later. The reference numeral 103 denotes heating resistive layers; and 104, 104' denote a pair of electrodes.

The reference numeral 120 denotes diodes acting as driving functional elements which are connected to the corresponding electrical/thermal converting element in series by the electrode 104 s0 that the current leakage is prevented when another electrical/thermal converting element is driven.

The reference numeral 210 denotes diodes acting as temperature detecting functional elements (temperature sensors) which are arranged on both sides of the semiconductor substrate 140 with the interposition of the electrical/thermal converting elements 110. These diodes are formed simultaneously with the formation of the driving diodes 120 by the process described later.

The reference numeral 130 denotes heating members acting as functional elements for heating the ink, which can perform heating control by controlling the current supplied on the basis of the outputs from the temperature sensors 210. These heating member 130 are also arranged on both sides of the semiconductor substrate 140.

The reference numeral 160 denotes a wiring portion for the electrical/thermal converting elements, which is arranged between an array of the electrical/thermal converting elements 110 and an array of the driving diodes 120. The reference numerals 170 denote pats for providing the electric connection to the external equipments.

Incidentally, while FIG. 8 shows a portion of the substrate 14, an opposite portion of the substrate has a symmetrical arrangement.

The concrete ranking is shown in FIG. 9. In the recording head as shown in FIG. 8 used in this example, the dispersion of the values $V_F$ is normally included in the following range:

$$0.540 \leqq V_F \leqq 0.579$$

And, thus, there occurs the dispersion of about 40 mV. If the sensors are used as they are, there will arise the detection temperature error of about 20° C. However, by controlling the dispersion of the sensor diodes by means of this method and by discriminating the rank of the diodes, the dispersion thereof can be reduced to ⅛ of the original dispersion, and thus, it is possible to suppress the dispersion within a range of about 2.2° C.

Figure 10:
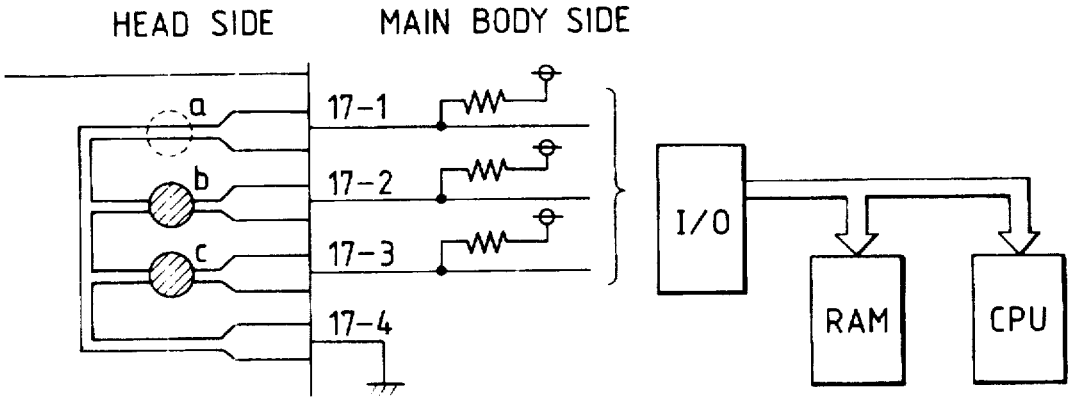
FIG. 10 is a schematic view for explaining an example of a method for reading the rank of the temperature sensor, according to the present invention.

FIG. 10 shows a reading circuit arranged in the main body side of the recording system when the head so ranked is used.

In this circuit, four reading pats 17-1 to 17-4 are provided, in which the pattern 17-4 is earthed. The three patterns 17-1, 17-2 and 17-3 are used to detect the rank of the sensor. In the illustrated example, the ranking pattern portions connected to the patterns 17-2 and 17-3 are bored, thus forming the open circuits regarding the patterns 17-2 and 17-3. The pattern portion connected to the pattern 17-1 is not bored or cut so that the voltage in this pattern is maintained at the earth voltage.

By comparing the head having the so cut pattern with a corresponding table such as shown in FIG. 9, it can be judged that the head is included in the rank 4 (i.e., the sensor has the dispersion of 0.560 to 0.565 at a room temperature).

The recording factor setting means reads the rank of the head whenever a power source of the main body of the recording system is turned on, and three-bit information read is stored in a RAM in place. The three-bit information stored in the RAM can be read by the CPU.

In this way, on the basis of the temperature information read, the current value to be supplied is determined, and such current is supplied to the heating member 130.

Figure 13:
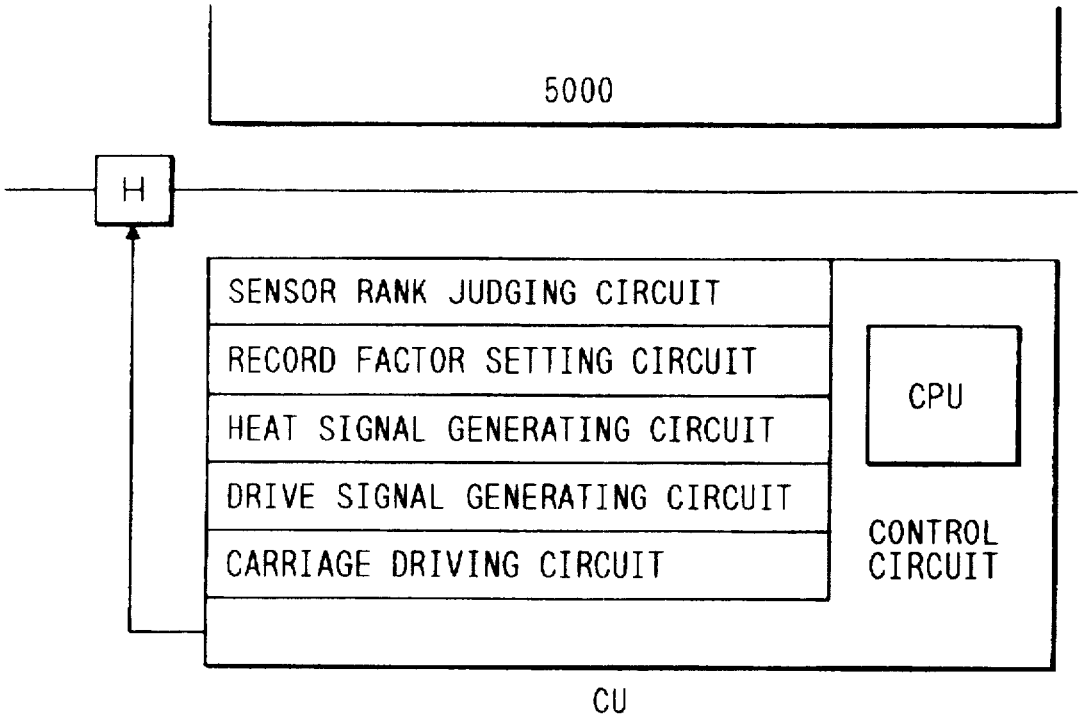
FIG. 13 is a schematic block diagram showing a recording system according to the present invention.

FIG. 13 is a schematic view of a recording system for explaining the above-mentioned control system, where the reference numeral P denotes a platen for feeding a recording medium; CU denotes a control circuit including a sensor rank judging circuit, record factor setting circuit, heat signal generating circuit, drive signal generating circuit, carriage driving circuit and CPU; and H denotes a head having an ink tank and removably mounted on the recording system.

As to the heat control, in place of the heating heater 130, the ink discharging electrical/thermal converting elements 110 may be energized at a level which does not discharge the ink. Of course, both the heating heater 130 and the electrical/thermal converting elements 110 may be Iused altogether. The controls of these elements are effected through a heat signal from the heat signal generating circuit on the basis of the parameters set by the record factor setting circuit. Further, when the driving condition for the ink discharge is changed, such change is effected through a drive signal from the drive signal generating circuit under the same process.

Incidentally, in the illustrated example, while the three-bit ranking into eight ranks was explained, the ranking is not limited to this three-bit into eight ranks, but may comprise four-bit into 16 ranks, five-bit into 32 ranks, two-bit into four ranks or the like, in accordance with the degree of the dispersion.

As apparent from the above, according to this example, since the dispersion of the voltage reduction $V_F$ in the normal direction of the temperature sensors comprising the diodes integrally formed on the head can be judged by ranking the sensors, it is possible to perform the fine and correct control according to the dispersion. Further, since the pattern portions on the PCB plate are merely cut, the setting can be done easily and the image quality can be improved.

Next, the substrate for the recording head will be explained.

Figure 11:
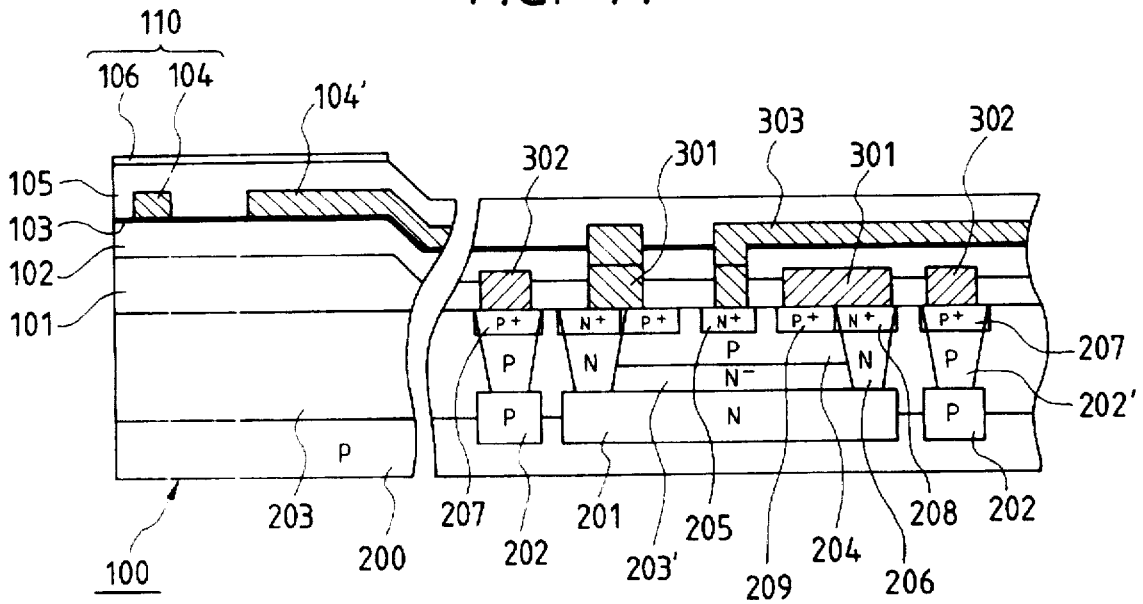
FIG. 11 is a schematic sectional view taken along the line A–A' of FIG. 8.

FIG. 11 is a schematic sectional view of the substrate 14 taken along the line A–A' of FIG. 8.

The reference numeral 200 denotes a P-type semiconductor plate made of a single crystal silicone material; 201 denotes an N-type semiconductor embedded layer; 202 and 202' denote P-type semiconductor separating areas; 203 denotes an N-type semiconductor epitaxial growth area; 204 denotes a P-type semiconductor base area; and 205 denotes an N-type semiconductor emitter area. The collector area is constituted by the N-type semiconductor areas 203', 201 and 206. Base-collector common electrodes 301 made of aluminium material and electrodes 302 are electrically connected through ohmic contact areas 207, 208 and 209 of high impurity density material.

In the recording head substrate having the above-mentioned construction, by forming the emitter area 205 acting as the diffusion layer slightly, the side extension of the diffusion layer can be suppressed, whereby it is possible to attain the high integration without worsening the pressure endurance and to reduce the diffusing ability between the emitter area 205 and the base area 204. In order to use such substrate as the recording head, the process for forming the electrical/thermal converting elements on the substrate is added. This process includes a step of electrically connecting between the electrical/thermal converting elements and the functional elements.

Now, an N-P-N transistor is formed, and the areas 206, 208 completely enclose the emitter area 205 and the base area 204. Further, each cell is electrically isolated by the element separating areas enclosing these areas and the separating areas 202, 202'.

In this way, by using the N-P-N transistor having the short-circuited base and collector as a diode, the temperature feature thereof is improved.

On the recording head 100 according to this embodiment, a heat accumulating layer 102 comprising an $SiO_2$ film is formed, by a PCVD method or a sputtering method, on a heat-oxidized $SiO_2$ film 101 on the substrate having the above-mentioned driving portions, and thereon, the electrical/thermal converting elements comprising an $HfB_2$ heat resistance layer 103 obtained by the sputtering method and aluminium electrodes 104, 104' obtained by the sputtering method are formed. Further, on the heating portions 110 of the electrical/thermal converting elements, an $SiO_2$ protection film 105 obtained by the sputtering method, and a Ta protection film 106 for preventing the canitation are formed.

Now, the $SiO_2$ film forming the heat accumulation layer 102 is formed integrally with insulation films between the wirings 301, 302 and 303.

With the arrangement obtained by the transistor having the short-circuited base and collector as shown in FIGS. 6 and 7, since the building-up feature thereof is excellent and the parasitic effect is relatively low, the dispersion between the elements can be further reduced. Further, by earthing the isolation electrodes 302, it is possible to prevent the electric charge from flowing into the adjacent cell, thus preventing the erroneous operation of the other elements.

The recording head is completed by attaching the top plate made of glass or resin material and adapted to constitute the ink discharging portion having the ink discharge opening for discharging for example the ink, to the substrate having the electrical/thermal converting elements and the functional elements operated as mentioned above.

Next, a manufacturing process for the substrate according to this embodiment will be explained.

(1) A silicon dioxidation film having a thickness of about 5000–20000 Å is formed on a surface of the P-type silicon substrate having the impurity density of about $1\times10^{12}$–$10^{16}$ $cm^{-3}$.

(2) The portion of the silicon oxidation film where the collector embedding area 201 of each cell is formed is removed by photo-lithography treatment.

(3) After a thin silicon oxidation film is formed, the N-type collector embedding area 201 having the impurity density of $1\times10^{19}$ $cm^{-3}$ or more is formed by 10–20 μm through heat diffusion by ion-pouring the N-type impurity such as P, As and the like into the film. In this case, the sheet resistance was selected to have a low value of 30 Ω/□ or less.

(4) Then, the portions of the oxidation film where the P-type isolation areas 202 should be formed are removed, and after a thin oxidation film having the thickness of about 100–3000 Å is formed, the P-type isolation areas 202 having the impurity density of $1\times10^{17}$–$10^{19}$ $cm^{-3}$ are formed through the heat diffusion by ion-pouring the P-type impurity such as B into the film.

Figure 12A:
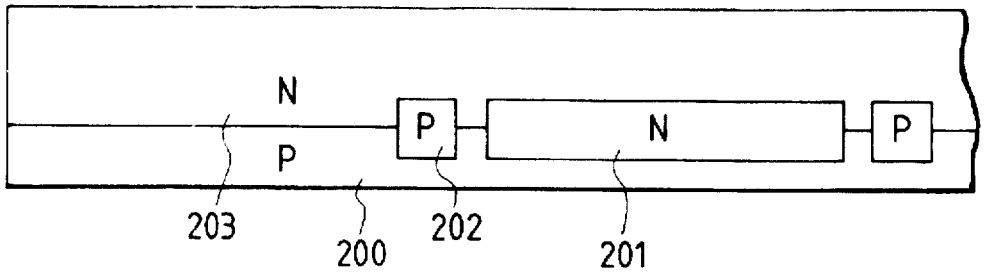
FIGS. 12A, 12B and 12C are schematic sectional views for explaining the manufacturing process for the substrate of the recording head according to the present invention.

(5) After the oxidation films are removed from the whole surface, the N-type epitaxial area 203 having the impurity density of about $1\times10^{12}$–$10^{16}$ $cm^{-3}$ is epitaxial-grown by about 5–20 μm (see FIG. 12A).

(6) Next, a silicon oxidation film having a thickness of about 100–300 Å is formed on a surface of the N-type epitaxial area, the resist is painted, the patterning is effected, and the P-type impurity is ion-poured into only an area where the low density base area 204 should be formed. After the resist is removed, the low density P-type base area 204 having the impurity density of $5\times10^{14}$–$5\times10^{17}$ $cm^{-3}$ is formed by 5–10 μm.

(7) After the oxidation film is removed from the whole surface and a new silicon oxidation film having a thickness of 1000–10000 Å is formed, the portions of the film where the P-type isolation areas 202' should be formed are removed, and a BSG film is coated on the whole surface by using the CVD method, and further, the P-type isolation areas 202' having the impurity density of $1\times10^{18}$–$10^{20}$ $cm^{-3}$ are formed, through the heat diffusion, by about 10 μm to reach the P-type isolation areas 202. The isolation areas 202' may be made of $BBr_3$ through the heat diffusion.

Figure 12B:
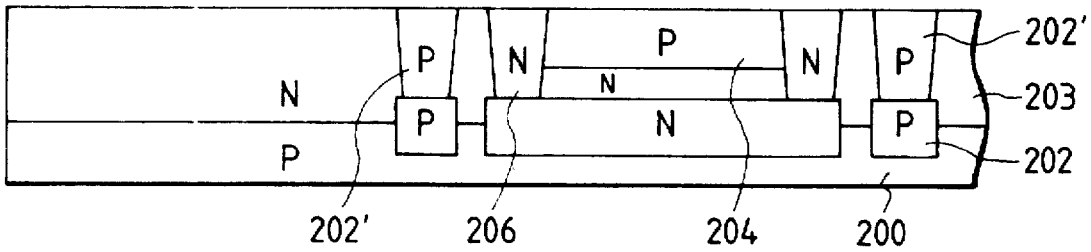

(8) After the BSG film is removed, a silicon oxidation film having a thickness of about 1000–10000 Å is formed, and then, after the portion of the film where the collector area 206 should be formed is removed, P ion is poured by forming PSG and the N-type collector area 206 is formed, through heat diffusion, to reach the collector embedding area 201. In this case, the sheet resistance was selected to have a low value of 10 Ω/□ or less, and the impurity density was selected to have a value of $1\times10^{18}-10^{20}$ $cm^{-3}$ (see FIG. 12B).

Figure 12C:
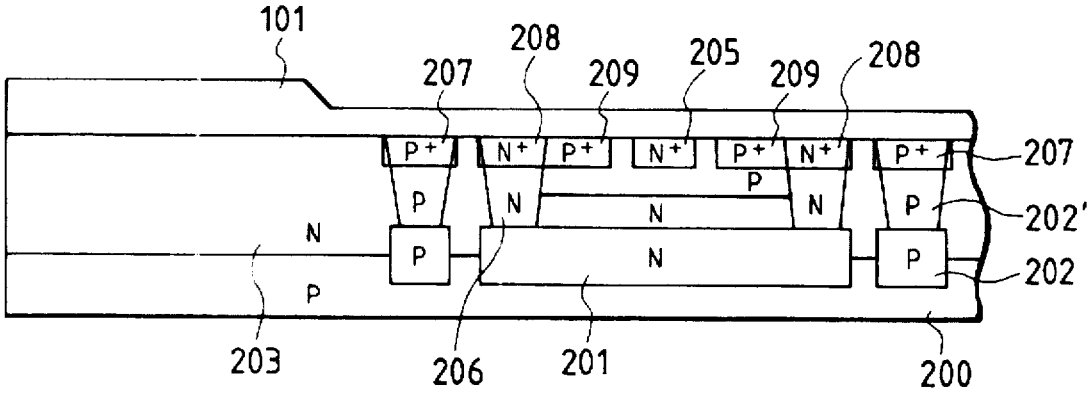

(9) Subsequently, after the oxidation film is removed from the cell areas, a silicon oxidation film having a thickness of 100–300 Å is formed, the resist patterning is performed, and the P-type impurity is ion-poured into only areas where the high density base area 209 and the high density isolation area 207 should be formed. After the resist is removed, the portions of the oxidation film where the N-type emitter area 205 and the high density N-type collector area 208 should be formed are removed, and then, a PSB film is formed on the whole surface. After the ion $N^+$ is poured, the high density P-type base area 209, high density P-type isolation area 207, N-type emitter area 205 and high density N-type collector area 208 are simultaneously formed through the heat diffusion. Incidentally, the thickness of each area was selected to have a value of 1.0 μm or less, and the impurity density was selected to have a value of $1\times10^{19}-10^{20}$ $cm^{-3}$ (see FIG. 12C). (10) Further, after the silicon oxidation film is partially removed from areas for connection to the electrodes, aluminium material is coated on the whole surface, and the aluminium material is removed from the area for electrical connection. And, the $SiO_2$ film 102 forming the heat accumulating layer and the insulation film between the layers 102 is formed on the whole surface by about 0.4–1.0 μm through the spattering method. The $SiO_2$ film may be formed by the CVD method.

Then, $HfB_2$ material is coated by a thickness of about 1000 Å to form the heat resistance layer 103. An aluminium layer is coated on this layer 103 and is patterned to simultaneously form the pair of electrodes 104, 104' of the electrical/thermal converting elements, anode electrode wiring (not shown) and cathode wiring (not shown) of the diodes, and the electric connections therefor.

Thereafter, the $SiO_2$ layer 105 acting as the protection layer for the electrical/thermal converting elements and the insulation layers between the aluminium layer wirings is deposited by the sputtering method, and Ta material is deposited on the heating portions of the electrical/thermal converting elements by a thickness of about 2000 Å to form the anti-canitation protection layer 106. In this way, the substrate as shown in FIG. 6 is obtained.

Next, each of and the relationship between an ink jet unit IJU, ink jet head IJH, ink tank IT, ink jet cartridge IJC, ink jet recording system body IJRA and carriage HC to which the present invention is preferably applied will be fully described with reference to FIGS. 14 to 18.

Figure 15:
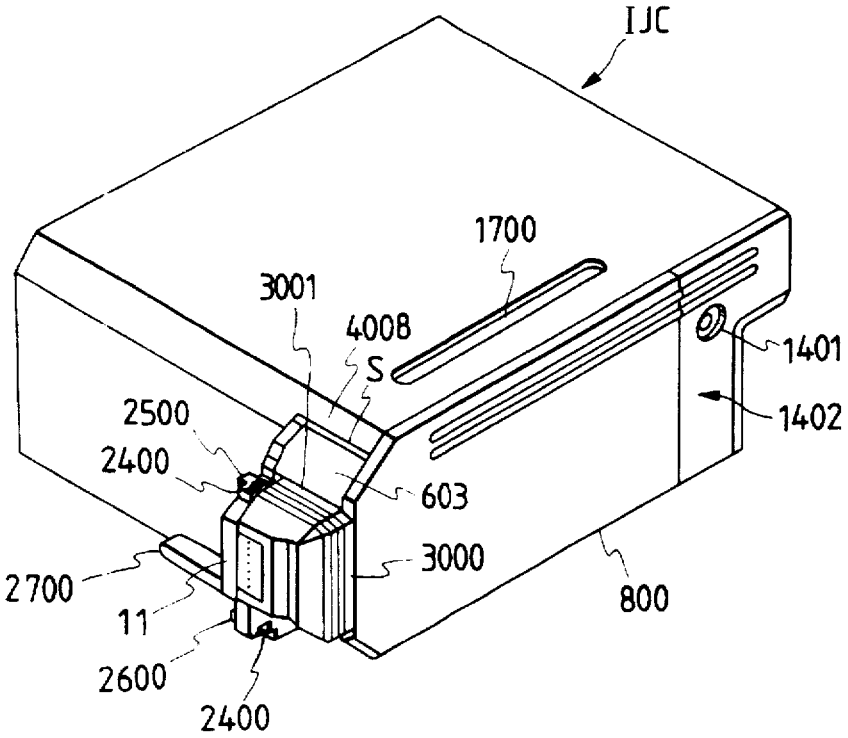

As apparent from FIG. 15 showing a perspective view of the ink jet cartridge, the ink jet cartridge IJC in this embodiment has a large ink containing ability and has a configuration that the front end of the ink jet unit IJU slightly protrude beyond the front face of the ink tank IT. The ink jet cartridge IJC can be fixedly supported by a positioning means and electrical contacts (described later) of the carriage HC (FIG. 17) mounted on the ink jet recording system IJRA and is of a non-returnable or disposable type which can be removably mounted on the carriage HC.

In the illustrated embodiment shown in FIGS. 14 to 18, since the construction includes various inventions created before the present invention was completed, the whole construction will be fully explained while describing such construction briefly.

(i) Construction of the Ink Jet Unit IJU

The ink jet unit IJU is a bubble jet type unit which performs the recording by utilizing the electrical/thermal converting elements for generating thermal energy adapted to create the film boiling into the ink in response to an electric signal.

Figure 14:
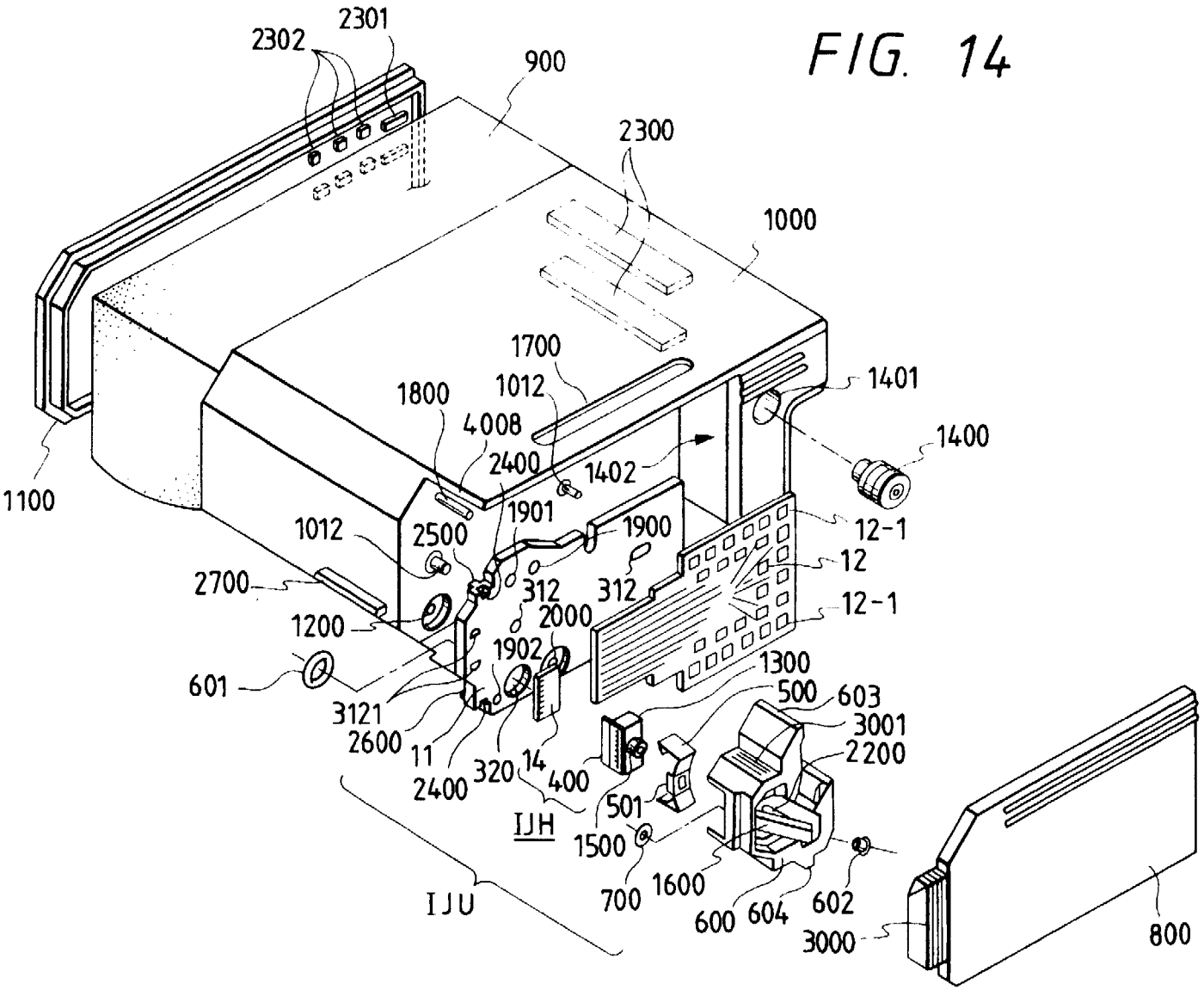
FIGS. 14, 15 and 16 are schematic perspective views for explaining an ink jet recording system preferably embodying the present invention.

In FIG. 14, the reference numeral 14 denotes a heater board on which a plurality of rows of electrical/thermal converting elements (discharging heaters) disposed on an Si substrate and aluminium electrical wiring for supplying the electric power to the elements are formed by the film forming technique. The reference numeral 12 denotes a wiring substrate corresponding to the heater board 14 and including wirings corresponding to those of the heater board 14 (which are connected to each other by the wire bonding) and patterns 12-1 arranged at the ends of the wirings for receiving the electric signals from the recording system.

The reference numeral 1300 denotes a top plate with recesses having partition walls for separating a plurality of ink passages independently and a common liquid chamber, which top plate integrally includes an ink receiving port 1500 for receiving the ink supplied from the ink tank and for introducing the ink into the common liquid chamber, and an orifice plate 400 having a plurality of ink discharge openings. While material of the top plate is preferably polysulfone, but other moulding resin material may be used.

The reference numeral 11 denotes a support (for example made of metal) for flatly supporting the back surface of the wiring substrate 12, which support 11 forms a bottom plate of the ink jet unit. The reference numeral 500 denotes an M-shaped leaf spring which urges the common liquid chamber at its central portion and urges a portion of the liquid passages with a line contact by a front bent portion 501 formed on the spring. The heater board 14 and the top plate 1300 are engaged by each other by engaging a foot of the leaf spring 500 extending through a hole 3121 of the support 11 with the back surface of the support 11, and the heater board 14 is firmly fixed to the top plate 1300 by the biasing force of the leaf spring 500 and its front bent portion 501. The support 11 has positioning holes 312, 1900, 2000 engaged by two positioning projections 1012 and positioning and heat fusing retaining projections 1800, 1801 formed on the ink tank IT and is further provided at its back surface with positioning projections 2500, 2600 for the carriage HC of the ink jet recording system IJRA. In addition, the support 11 has a hole 320 through which an ink supply tube 2200 (described later) for permitting the ink supply from the ink tank. The wiring substrate 12 is attached to the support 11 by an adhesive.

Incidentally, recesses 2400 are formed in the support 11 near the positioning projections 2500, 2600, respectively, and are positioned so that, when the ink jet cartridge IJC is assembled (see FIG. 15), the recesses are situated on the extension points of a head front area constituted by a plurality of parallel grooves 3000, 3001 at three sides of the head, thus preventing the foreign matter such as dust, ink and the like from reaching the positioning projections 2500, 2600.

Figure 17:
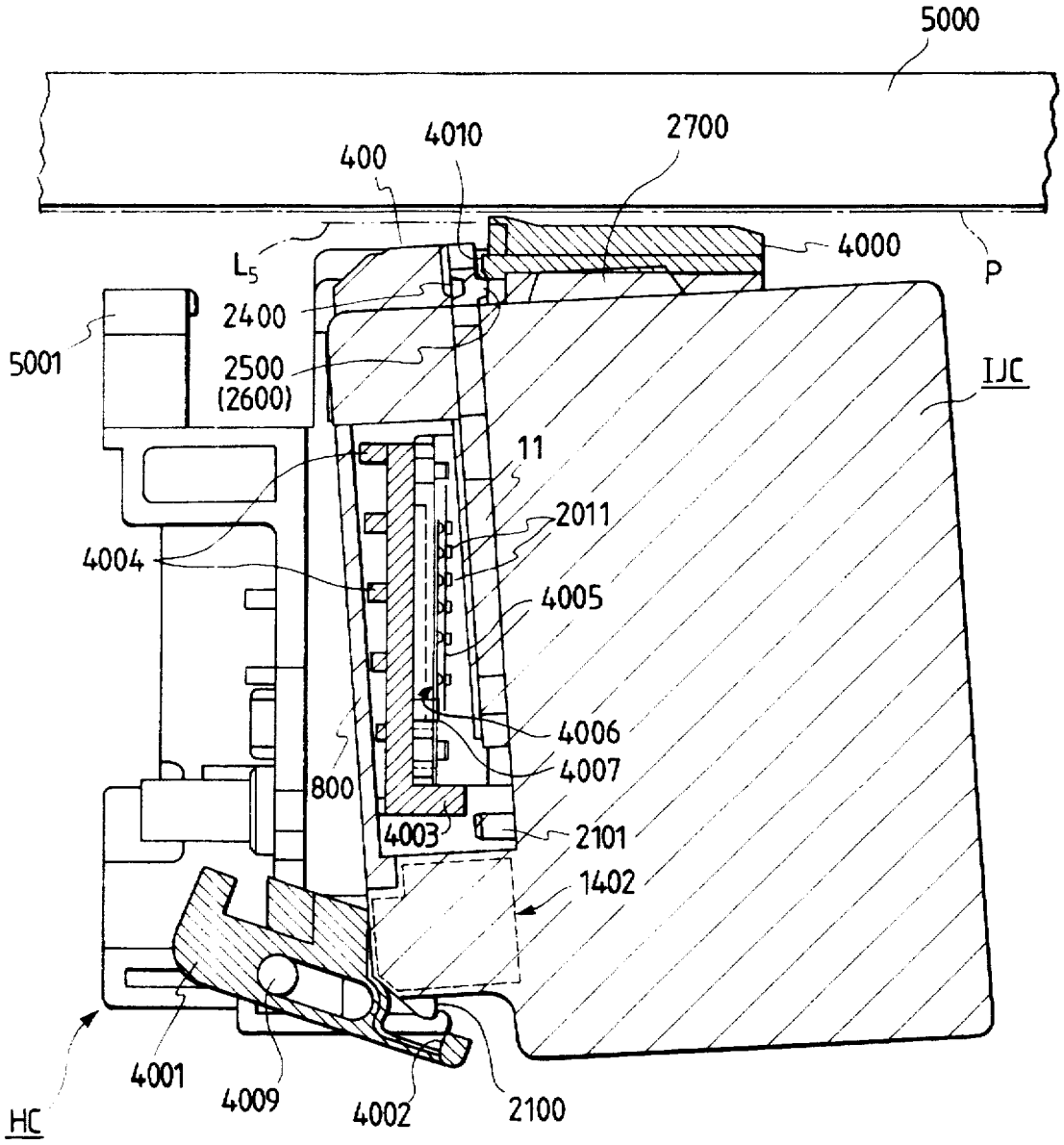
FIG. 17 is a sectional plan view for explaining the ink jet recording system preferably embodying the present invention.

As seen from FIG. 17, a lid member 800 having the parallel grooves 3000 forms an outer wall of the ink jet cartridge IJC and defines a space for receiving the ink jet unit IJU. Further, an ink supply member 600 having the parallel grooves 3001 has an ink supply conduit 1600 communicating with the ink supply tube 2200, which ink supply conduit is fixedly supported at the ink supply tube 2200 side in a cantilever fashion. And, in order to ensure the capillary phenomenon between the ink supply conduit fixing side and the ink supply tube 2200, a seal pin 602 is inserted. Incidentally, the reference numeral 601 denotes a packing for providing a connection seal between the ink tank IT and the ink supply tube 2200; and 700 denotes a filter disposed at an end of the ink supply tube near the ink tank.

Since the ink supply member 600 is formed in the moulding operation, it can be manufactured at a low cost and with high accuracy, and, even when the ink jet units are manufactured in mass-production, the cantilevered ink supply conduit 1600 of the ink supply member can stably be pressed against the ink receiving port 1500. In the illustrated embodiment, the perfect communication can be positively obtained merely by applying any sealing adhesive to the pressed contacting portion between the port 1500 and the conduit 1600 from the ink supply member side.

Incidentally, the ink supply member 600 is fixedly attached to the support 11 by protruding pins (not shown) formed on the back surface of the ink supply member 600 through holes 1901, 1902 formed in the support 11 and then by fusing the protruding ends of the pins onto the back surface of the support 11 by heat. Since such heat-fused and slightly protruding portions on the back side of the support 11 can be received in recesses (not shown) formed in a surface of the ink tank IT to which the ink jet unit IJU are to be attached, the ink jet unit IJU can be correctly positioned.

(ii) Construction of the Ink Tank IT The ink tank comprises a cartridge body 1000, an ink absorber 900, and a lid member 1100 for sealingly closing the cartridge body 1000 after the ink absorber 900 is inserted into the cartridge body from a side opposite to the side to which the unit IJU is attached.

The ink absorber 900 is arranged in the cartridge body 1000 for holding the ink therein. The reference numeral 1200 denotes a supply port for supplying the ink to the unit ICU comprising the above-mentioned elements 100–600. This port 1200 also serves as a pouring port for impregnating the ink into the ink absorber 900 by pouring the ink from this port before the ink jet unit IJU is installed on a portion 1010 of the cartridge body 1000.

In the illustrated embodiment, the portion through which the ink can be supplied include, an atmosphere vent opening 1401 and this supply port 1200. In order to improve the ink supply from the ink absorber, an air space or area in the tank defined by ribs 2300 of the cartridge body 1000 and partial ribs 2301, 2302 of the lid member 1100 is communicated with the atmosphere vent opening 1401 and is formed in a corner area remote from the supply port 1200. Thus, relatively good and uniform supply of the ink to the ink absorber can be effected through the supply port 1200. This is very effective in practical use. The ribs 2300 comprise four ribs arranged on the surface of the cartridge body 1000 at its rear portion and extending parallel to a carriage moving direction, so that the ink absorber is prevented from being closely contacted with the rear surface. Similarly, the partial ribs 2301, 2302 are formed on the inner surface of the lid member 1100 on extension lines of the ribs 2300, but, unlike to the ribs 2300, the partial ribs are divided into plural pieces to increase the air existing space than the ribs 2300. Incidentally, the partial ribs 2301, 2302 are distributed on an area smaller than a half of the whole surface area of the lid member 1100.

With these ribs, it is possible to positively direct the ink in the ink absorber at the corner area remote from the supply port 1200 by the capillary action toward the supply port 1200 with a more stable condition.

The reference numeral 1401 denotes the aforementioned atmosphere vent opening formed in the lid member for communicating the interior of the cartridge with the atmosphere; and 1400 denotes a liquid anti-flow member arranged in the atmosphere vent opening 1400 for preventing the ink from leaking through the opening 1401.

The ink containing space in the ink tank IT has a parallelepipedal shape, and the longer side surfaces thereof correspond to the side wall of the tank. Thus, the above-mentioned rib arrangement is particularly effective. However, the longer side surfaces are parallel to the carriage moving direction or the ink containing space has a cubic shape, the ink supply from the ink absorber 900 can be stabilized by arranging the ribs on the whole surface of the lid 1100.

Figure 16:
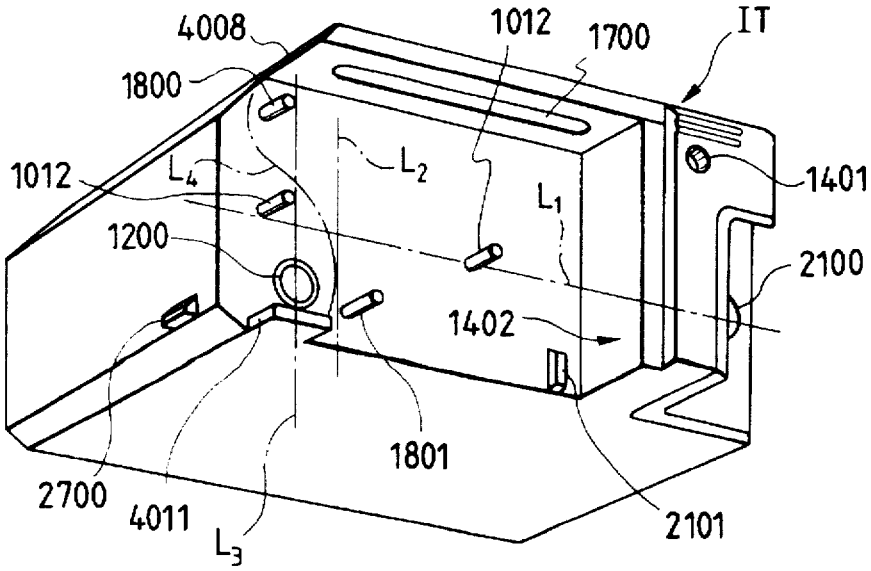

Further, the construction of the attachment surface of the ink tank IT to the ink jet unit IJU is shown in FIG. 16.

When a straight line passing through centers of the discharge openings of the orifice plate 400 and extending parallel to a mounting reference face provided on the bottom surface of the tank IT or the top surface of the carriage is designated by $L_1$, the two positioning projections 1012 adapted to be engaged by the positioning holes 312 formed in the support 11 are disposed on this straight line $L_1$. The height of each positioning projection 1012 is slightly smaller than a thickness of the support 11, these projections being used to position the support 11. In FIG. 16, on the straight line Li, there is also disposed a pawl 2100 adapted to be engaged by an engagement surface 4002 of a bent portion of a carriage positioning hook 4001, so that the force for positioning the carriage acts in a surface area parallel to the above-mentioned reference face including the straight line $L_1$ (FIG. 17). Such relationship is effective since the positioning accuracy for only the ink tank equals to the positioning accuracy for the discharge openings of the head (The details will be described later with reference to FIG. 17).

Further, projections 1800, 1801 of the ink tank corresponding to holes 1900, 2000 of the support 11 (through-which the ink tank is fixed to the support) are longer than the aforementioned projections 1012, so that the portions of the projections protruded from the support 11 can be fused by heat to be fixed to the surface of the support. When a straight line perpendicular to the straight line $L_1$ and passing through the projection 1800 is designated by $L_3$ and a straight line perpendicular to the line $L_1$ and passing through the projection 1801 is designated by $L_2$, since the center of the supply port 1200 is situated substantially on the straight line $L_3$, the connecting condition between the supply port 1200 and the ink supply tube 2200 is stabilized, and, if the system is dropped or is subjected to any shock, the load acting on such connecting condition can be reduced. Incidentally, since the straight line $L_2$ is not aligned with the straight line $L_3$ and the projections 1800, 1801 are situated around the projection 1012 of the ink jet head IJH, the positioning of the head IJH to the ink tank IT is further ensured and reinforced.

Incidentally, a curve shown by $L_4$ indicates a position of an outer wall of the ink supply member 600 when installed. Since the projections 1800, 1801 are situated along the curve $L_4$, the sufficient strength and positional accuracy are provided by these projections, regardless of the weight of the front end portion of the head IJH. Incidentally, the reference numeral 2700 denotes a front tab of the ink tank IT adapted to be inserted into a hole formed in a front plate 4000 of the carriage. The reference numeral 2101 denotes an engagement tab for engaging by a further engagement portion of the carriage HC.

Since the ink tank IT is covered by a lid or cap 800 after the ink jet unit IJU is mounted on the ink tank, the ink jet unit IJU is enclosed except at its lower opening. However, in the ink jet cartridge IJC, since the lower opening thereof is situated closely adjacent to the carriage HC when it is mounted on the carriage, the ink jet cartridge will be enclosed substantially at all sides thereof.

Thus, the heat generated from the ink jet head IJH disposed in this enclosed space is effective to maintain a certain temperature in this space.

However, when the recording system is continuously operated for a long time, the temperature in this space is increased.

To avoid this, in the illustrated embodiment, in order to assist the natural heat dispersion, a slit 1700 having a width smaller than that of the aforementioned space is formed in the upper surface of the cartridge IJC so that the increase in temperature in the space is prevented and the uniformity of the temperature distribution in the whole ink jet unit IJU is maintained regardless of the change in the environmental condition.

When the ink jet cartridge IJC is assembled, the ink is supplied to the supply tank 600 through the supply port 1200, hole 320 formed in the support 11 and an introduction opening formed in the back surface of the supply tank 600 at its central position. After flowing in the supply tank, the ink then flows into the common liquid chamber through an outlet opening formed in the tank, an appropriate supply tube and an ink introduction opening 1500 of the top plate 1300. At conjunction portion in such ink flowing path, any packings made of, for example, silicon rubber, butyl rubber and the like are arranged to ensure the sealing thereof and to keep the ink flowing path without leakage.

Incidentally, in the illustrated embodiment, the top plate 1300 is made of resin material having a good anti-ink property (not deteriorated by the ink) such as polysulfone, polyethersulfone, polyphenylene oxide, polypropylene and the like, and is moulded integrally simultaneously with the orifice plate 400 in a mould.

As mentioned above, since the ink supply member 600, top plate 1300 and orifice plate 400, and the ink tank body 1000 are formed as integral parts, respectively, the assembling accuracy is increased and the quality of the product is also improved even if it is manufactured in the massproduction line. Further, since the number of parts is reduced in comparison with the conventional manufacturing process, it is possible to obtain the desired features positively and easily.

(iii) Attachment of Ink Jet Cartridge IJC to Carriage HC

In FIG. 17, the reference numeral 5000 denotes a platen roller for guiding a recording medium from a downward to a upward direction. The carriage HC can be shifted along the platen roller 5000. On the front side of the carriage facing the platen roller, the front plate 4000 (having a thickness of 2 mm) disposed on the front side of the ink jet cartridge IJC, an electric connection portion supporting plate 4003 for holding a flexible sheet 4005 provided with patterns 2011 corresponding to the patterns 12-1 of the wiring substrate 12 of the cartridge IJC and a rubber pad 4006 for generating an elastic force for urging the flexible sheet from its back in coincidence with the patterns 2011, and a positioning hook 4001 for fixing the ink jet cartridge IJC in a recording position are arranged.

The front plate 4000 has a positioning projecting surfaces 4010 in correspondence with the aforementioned positioning projections 2500, 2600 of the support 11 of the cartridge, and is subjected to a vertical force directing toward the projecting surfaces 4010 after the carriage is mounted. Thus, on the front plate facing the platen roller, a plurality of reinforcement ribs (not shown) are provided in the direction of the vertical force. These ribs also form a head protection protruding portion protruding toward the platen roller slightly (about 0.1 mm) from a front surface position $L_5$ when the cartridge is mounted.

The electric connection portion supporting plate 4003 has a plurality of reinforcement ribs 4004 disposed in a direction perpendicular to the aforementioned ribs and the degree of the projection of these ribs 4004 is gradually decreased from the platen roller to the hook 4001. Thus, the position of the cartridge when mounted is inclined as shown in FIG. 17. Further, the supporting plate 4003 has a positioning face 4008 facing the platen roller, and a positioning face 4007 facing the hook to stabilize the electrical contact condition. Between these faces, a pattern contact area is formed, and the supporting plate defines an amount of the deformation of a ridge rubber sheet 4006 corresponding to the pattern 2011. These positioning faces abut against the surface of the wiring substrate 12 when the cartridge is mounted in a recordable position. In the illustrated embodiment, since the patterns 12-1 of the wiring substrate 12 are arranged symmetrically with respect to the aforementioned straight line $L_1$, the amounts of the deformation of the ridges of the rubber sheet 4006 are uniform to more stabilize the contacting pressure between the pats 2011 and 12-1. In the illustrated embodiment, the patterns 12-1 are arranged in two upper and lower rows and in two lines. In FIG. 14, while the patterns 12-1 were merely schematically shown for illustrating the other construction with detail, it should be noted that these patterns 12-1 have the aforementioned ranking patterns 17 and the patterns 2011 have a corresponding construction for reading the ranking patterns.

The hook 4001 has a slot engaged by a fixed shaft 4009. By using the lost motion of the slot, after the hook is rotated in an anti-clockwise direction from a position shown in FIG. 17, by shifting the hook in the left direction along the platen roller 5000, the ink jet cartridge IJC can-be positioned with respect to the carriage HC. While the hook 4001 can be shifted in any manner, but preferably the movement of the hook is effected by a lever arrangement and the like. In any case, during the rotation of the hook 4001, while the cartridge IJC is shifted toward the platen roller, the positioning projections 2500, 2600 are shifted to a position where they can be abutted against the positioning faces 4010. Consequently, by shifting the hook 4001 to the left, the engagement surface 4002 of the bent portion of the hook engages by the pawl 2100 of the cartridge IJC. Then, by rotating the cartridge IJC in a horizontal plane around the contacting area between the positioning faces 2500 and 4010, the patterns 12-1 are eventually brought in contact with the patterns 2011. And, when the hook 4001 is held in a predetermined position or fixed position, the perfect contact between the patterns 12-1 and 2011, the perfect contact between the positioning faces 2500 and 4010, the contact between the engagement surface 4002 and the pawl 2100, and the contact between the wiring substrate 12 and the positioning surfaces 4007, 4008 are simultaneously attained, thus completing the holding of the cartridge IJC with respect to the carriage.

(iv) Summary of Ink Jet Recording System Body

Figure 18:
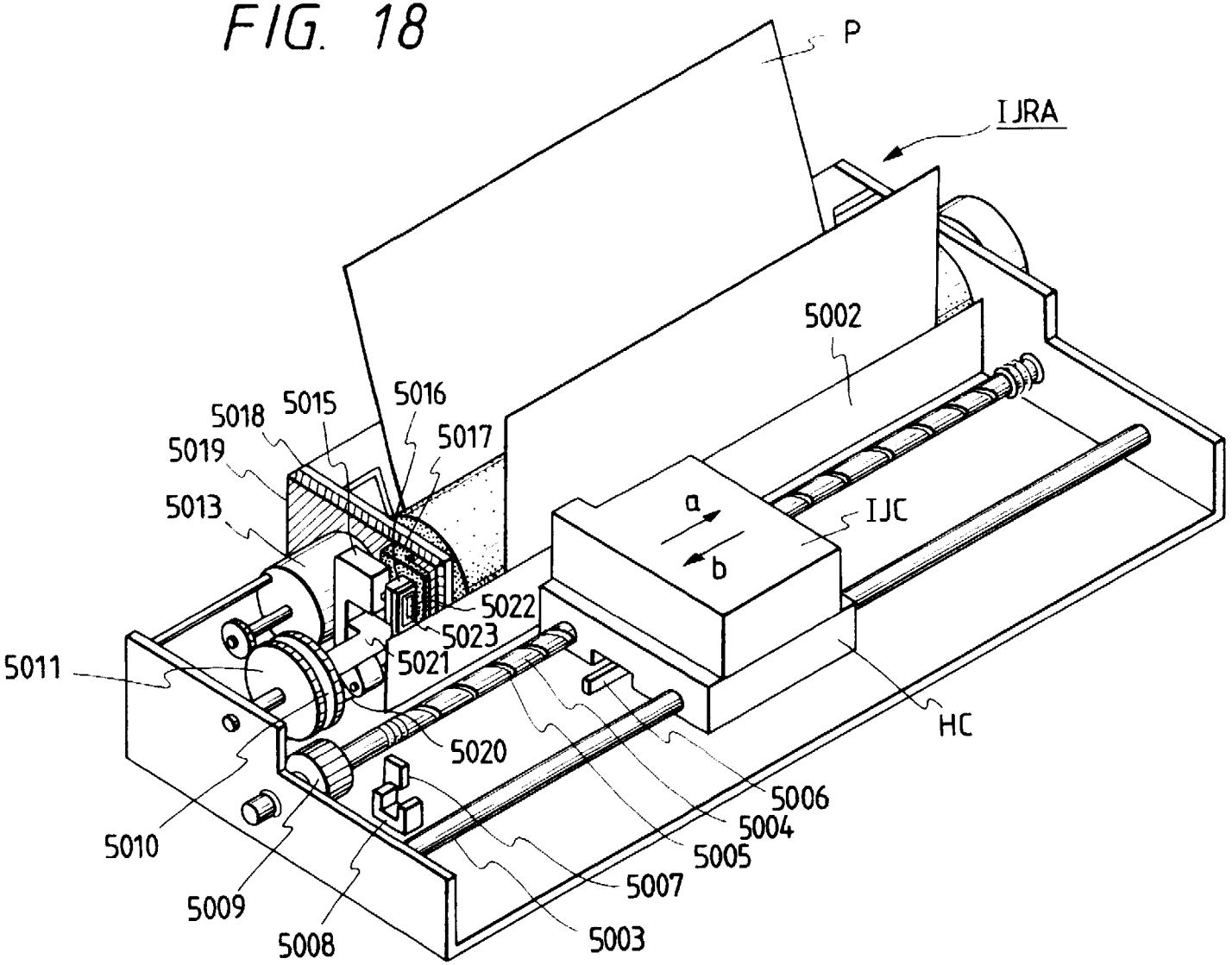
FIG. 18 is a schematic perspective view of the ink jet recording system preferably embodying the present invention.

FIG. 18 schematically shows an ink jet, recording system embodying the present invention. In the ink jet recording system, the carriage HC has is a pin (not shown) engaged by a spiral groove 5004 formed in a lead screw 5005 rotated through driving force transmitting gears 5011, 5009 in response to the normal rotation of a driving motor 5013, s0 that the carriage can be reciprocably shifted in directions shown by the arrows a and b. A sheet holder 5002 urges a sheet (recording medium) against the platen roller 5000 through the moving direction of the carriage.

Home position detecting means 5007, 5008 detect the presence of a lever 5006 of the carriage by their photo couplers to control the switching of the rotational direction of the driving motor 5013. A supporting member 5016 supports a cap member 5022 covering the front surface of the recording head, and an absorbing means 5015 performs the absorbing recovery of the recording head through an opening 5023 formed in the cap member. A support member 5019 supports a cleaning blade 5017 for movement in a fore and aft direction, and these are supported by a support plate 5018 of the body. It should be noted that the cleaning blade is not limited to the illustrated configuration, but may be any conventional one. Further, a lever 5021 for initiating the suction for the absorbing recovery is shifted in synchronous with the movement of a cam 5020 engaged by the carriage, and the movement of the lever can be controlled by the driving force from the driving motor through a conventional transmitting means such as a clutch and the like.

In the illustrated embodiment, while the capping, cleaning and absorbing recovery operations are performed by the action of the lead screw 5005 when the carriage reaches the home position, these operations may be effected at well-known timings. The above-mentioned constructions or arrangements are excellent when used independently or in combination, and are preferable ones for use in the present invention.

An example of the most characteristic circuit among these drive control systems was shown in FIG. 13. Now, the relationship between FIG. 13 and FIG. 10 will be described. In FIG. 13, the sensor rank judging circuit reads out the rank data on a data line electrically connected to the patterns 17-1, 17-2 and 17-3 on the basis of the timing controlled by the CPU through a noise preventing shunt circuit (not shown). The resistors shown in FIG. 10 are pull-up resistors which can keep the line voltage at a constant value (for example, +5 volts) when the line of the pattern is opened.

Embodiment 2

Figure 19:
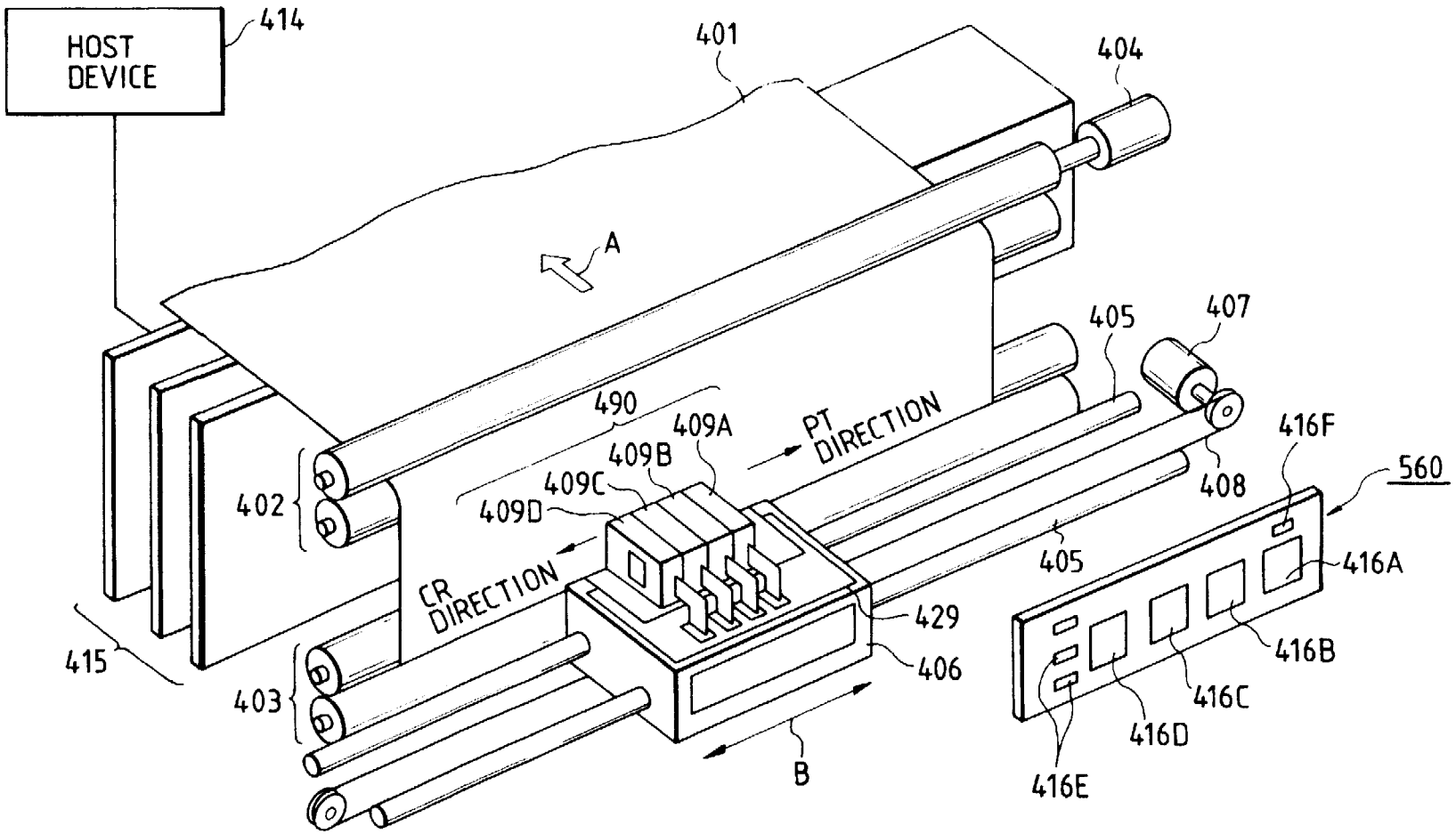
FIG. 19 is a perspective view showing a construction of an ink jet recording system to which the present invention is applicable.

FIG. 19 shows an example of a color ink jet recording system of a so-called bubble jet type having the electrical/thermal converting elements as an energy generating means, embodying the present invention.

In FIG. 19, a recording medium 401 such as a paper or a plastic sheet is supported by two pair of feeding rollers 402, 403 arranged on both upper and lower sides of a recording area, and is fed in a direction shown by the arrow A by means of the feeding rollers 402 driven by a sheet feeding motor 404. Ahead of the feeding rollers 402, 403, a guide shaft 405 is arranged in parallel to these rollers. A carriage 406 is shifted along the guide shaft 405 by the output of a carriage motor 407 through a wire 408 in a direction shown by the arrow B.

An ink jet recording head unit 490 of the bubble jet type is mounted on the carriage 406. The recording head unit 490 can form a color image and is arranged in a scanning direction, and includes four recording heads 409A, 409B, 409C and 409D corresponding to cyan (C) ink, magenta (M) ink, yellow (Y) ink and black (BK) ink, respectively. On a front surface of each recording head 409, i.e., on a surface facing the recording medium 401 with a predetermined distance (for example, 0.8 mm), a recording portion having a plurality (for example, 64, 128, 256) of ink discharge openings arranged in line is provided.

More particularly, on the surface facing the recording medium 401, a plurality of ink discharge openings 410 arranged in a vertical direction at a predetermined interval are formed. By generating the bubble 411A in the ink by energizing the electrical/thermal converting element (heat resistor and the like) 411 associated with each discharge opening 410, an ink droplet is flies from the corresponding discharge opening due to the pressure created by the bubble. In this way, by transferring the ink droplets onto the recording medium 401 at a predetermined pattern, a desired recording is effected.

On each recording head 409, a circuit substrate of a driving circuit (driver) 429 for performing the driving as mentioned above is mounted.

A control portion including a control circuit (CPU), ROM and RAM provided in the CPU and the like is formed on a control substrate 415, and this control portion receives a command signal and a data signal from a host device 414 such as a computer and applies the driving voltage (heat voltage) of the electrical/thermal converting element to each recording head 409A–409D through a heat driver 413 and driving sources for various motors, on the basis of the received signal.

An operation panel 560 attached to an outer casing (not shown) of the recording system comprises a key setting portion including an on-line/off-line changing key 416A, a line feed key 416B, a form feed key 416C, and a record mode changing key 416D, and a display portion including a plurality of alarm lamps 416E and a warning lamp 416F such as a power source lamp.

Figure 20:
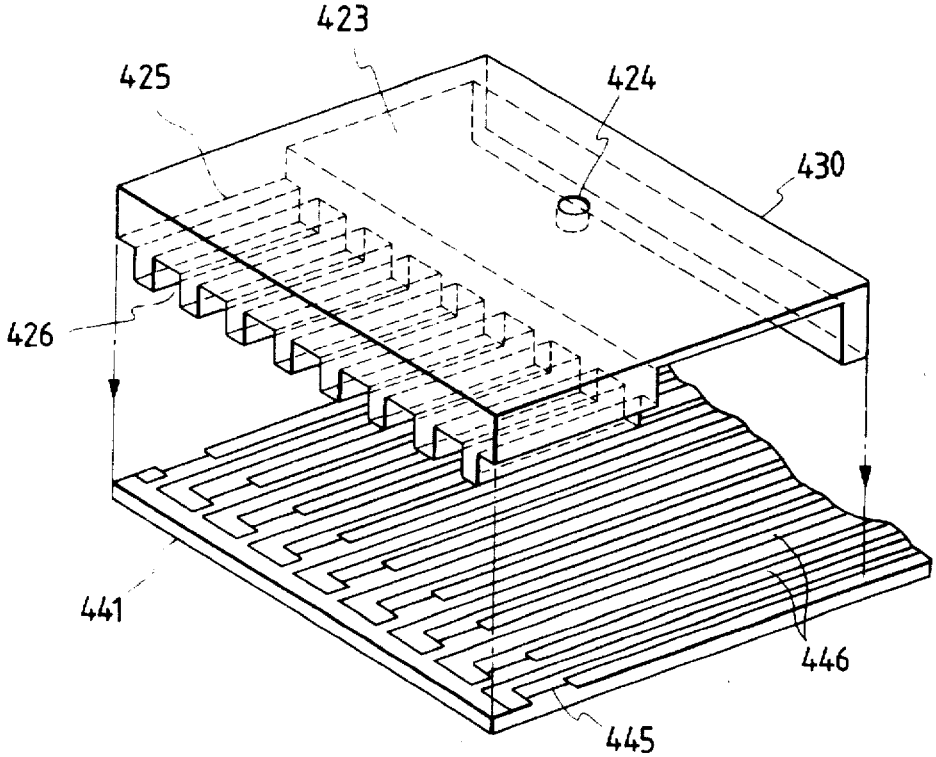
FIG. 20 is a perspective view of a recording head of the system of FIG. 19.

FIG. 20 shows an example of a head chip arranged in each recording head according to this embodiment. A heater board 441 comprises a silicon substrate on which electrical/thermal converting elements (discharging heaters) 445 and aluminium wirings 446 for supplying electric power to the discharging heaters are formed by the film forming technique. The head chip is completed by adhering a top plate 430 having partition walls for defining recording liquid passages 425 to the heater board 441.

The recording liquid (ink) is supplied to a common liquid chamber 423 through a supply port 424 formed in the top plate 430, and then is introduced into each nozzle 425. When the heater 445 is heated by energizing it, the bubble is created in the ink filled in the nozzle 425, thereby discharging the ink droplet from the discharge opening 426.

Figure 21A:
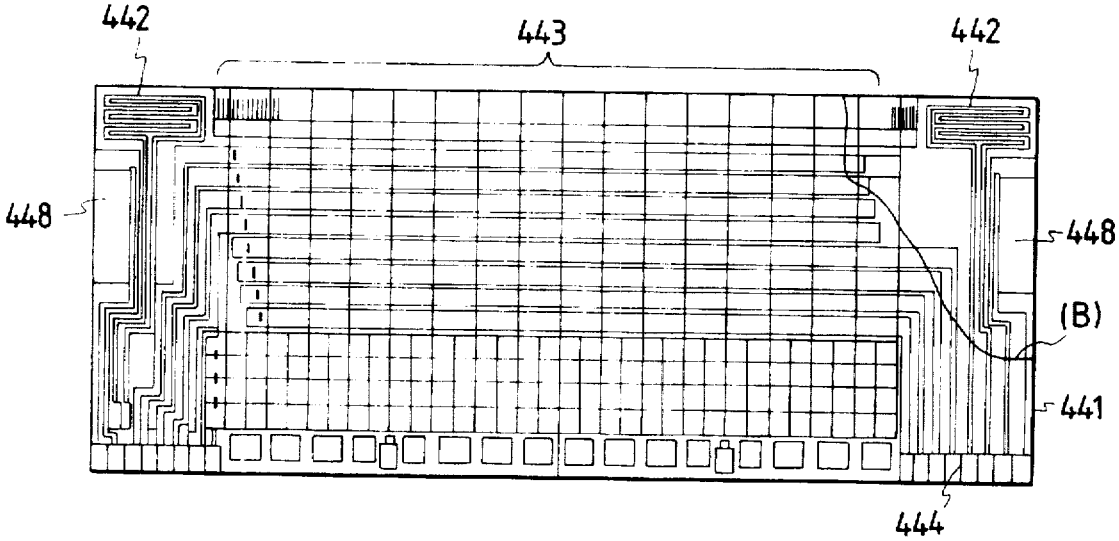
FIGS. 21A and 21B are a plan view and a partial enlarged view, respectively, of a heater board which is applicable to the recording head of FIG. 20.
Figure 21B:
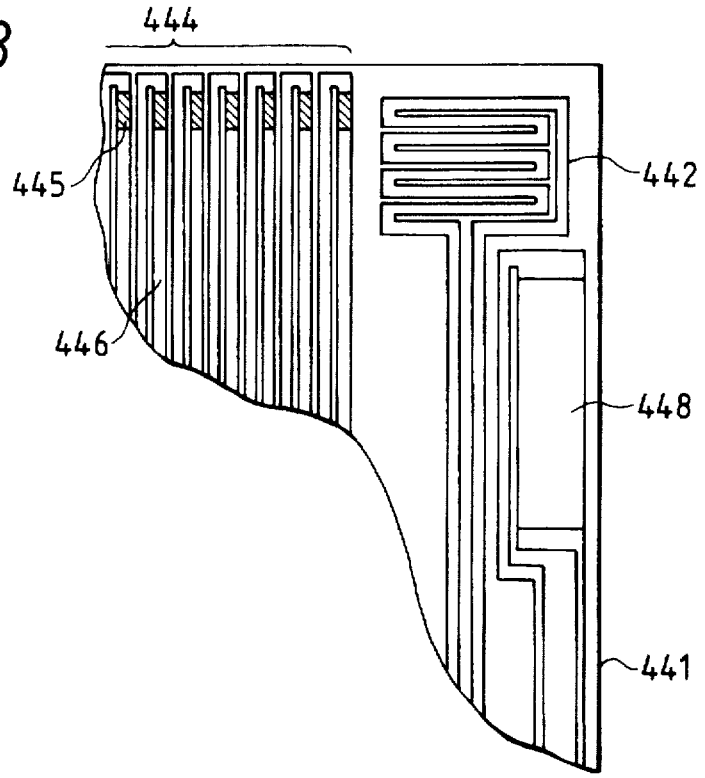

FIGS. 21A and 21B are a plan view and an enlarged view respectively of the heater board according to this embodiment.

In FIG. 21A, the reference numeral 443 denotes a discharging heater portion. Terminals 444 are connected to any external equipments through the wire bonding. Temperature sensors 442 acting as temperature detecting means are formed on the discharging heater portion 443 by the film forming technique as same as that used in the formation of the discharging heater portion. FIG. 21B shows a portion B including the sensor 442 of FIG. 21A in an enlarged scale. The reference numeral 448 denotes a lagging or heat keeping heater acting as a heating means.

Since the sensors 442 are formed by the film forming technique like the other elements, they have very high accuracy, and they can be made of material having the conductivity varying in accordance with the temperature, such as aluminium, titanium, tantalum, tantalum pentoxide, niobium and the like. For example, among these materials, aluminium is a material which can be used to form the electrodes, titanium is a material which can be disposed between the heat resistance layer constituting the electrical/thermal converting element and the electrode to enhance the adhesion ability therebetween, and tantalum is a material which can be disposed on the protection layer on the heat resistance layer to enhance the anti-canitation ability of the protection layer. Further, in order to reduce the dispersion in the processes, the width of the wiring is increased, and, in order to reduce the influence from the wiring resistance, the wirings are arranged in a zigzag fashion, thereby providing high resistance.

Figure 21C:
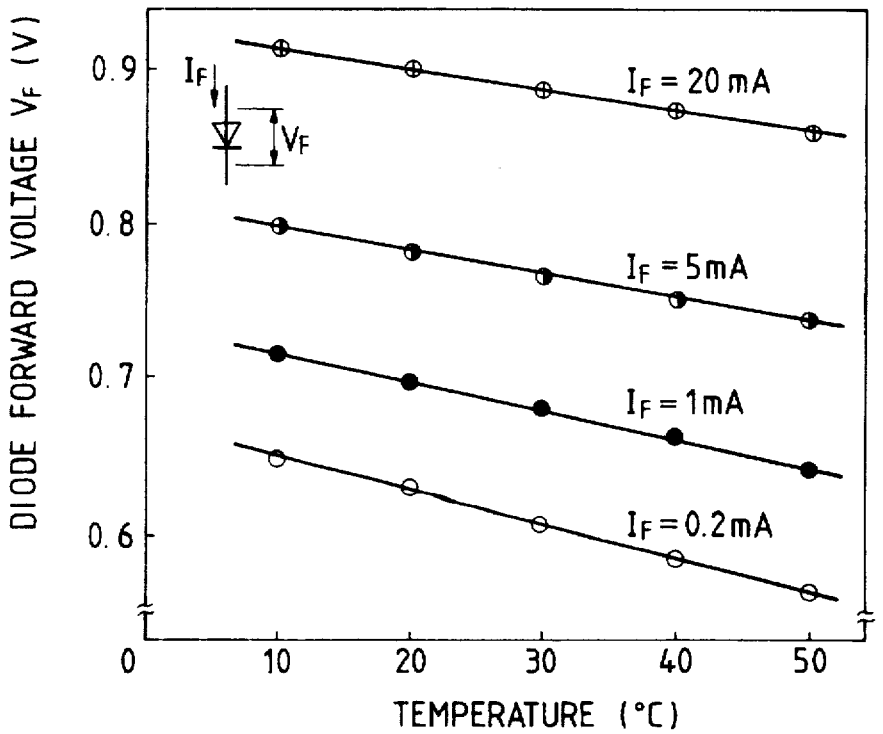
FIG. 21C is a graph for explaining the temperature feature of the diode applicable to the temperature sensor of FIGS. 21A and 21B.

Incidentally, the sensor 442 may be constituted by a diode to effectively utilize the feature of the diode that the voltage in the normal direction of the diode (i.e., diode forward voltage) is changed in response to the temperature. FIG. 21C shows the temperature feature of the diode.

The heat keeping heater 448 can be made of material (for example, $HfB_2$) the same as that of the heat resistance layer of the discharging heater 405, but may be made of other material constituting the heater board, such as aluminium, tantalum, titanium and the like.

Next, a mode of the temperature control for the recording head according to this embodiment will be explained.

In the recording head shown in FIG. 20 according to this embodiment, as shown in FIG. 21, since the temperature sensors 442 are arranged on both sides of the heater board 441,. the temperature distribution on the substrate in the direction of the array of the nozzles 425 can be known from the outputs of the temperature sensors. Further, since the heat keeping heaters 448 are arranged in the vicinity of the temperature sensors 442, the temperature detection is swiftly responsive to the change in temperature due to the heating. By using this feature, the control for keeping the temperature distribution on the substrate at a given value can be performed with high response and high stability.

Figure 22:
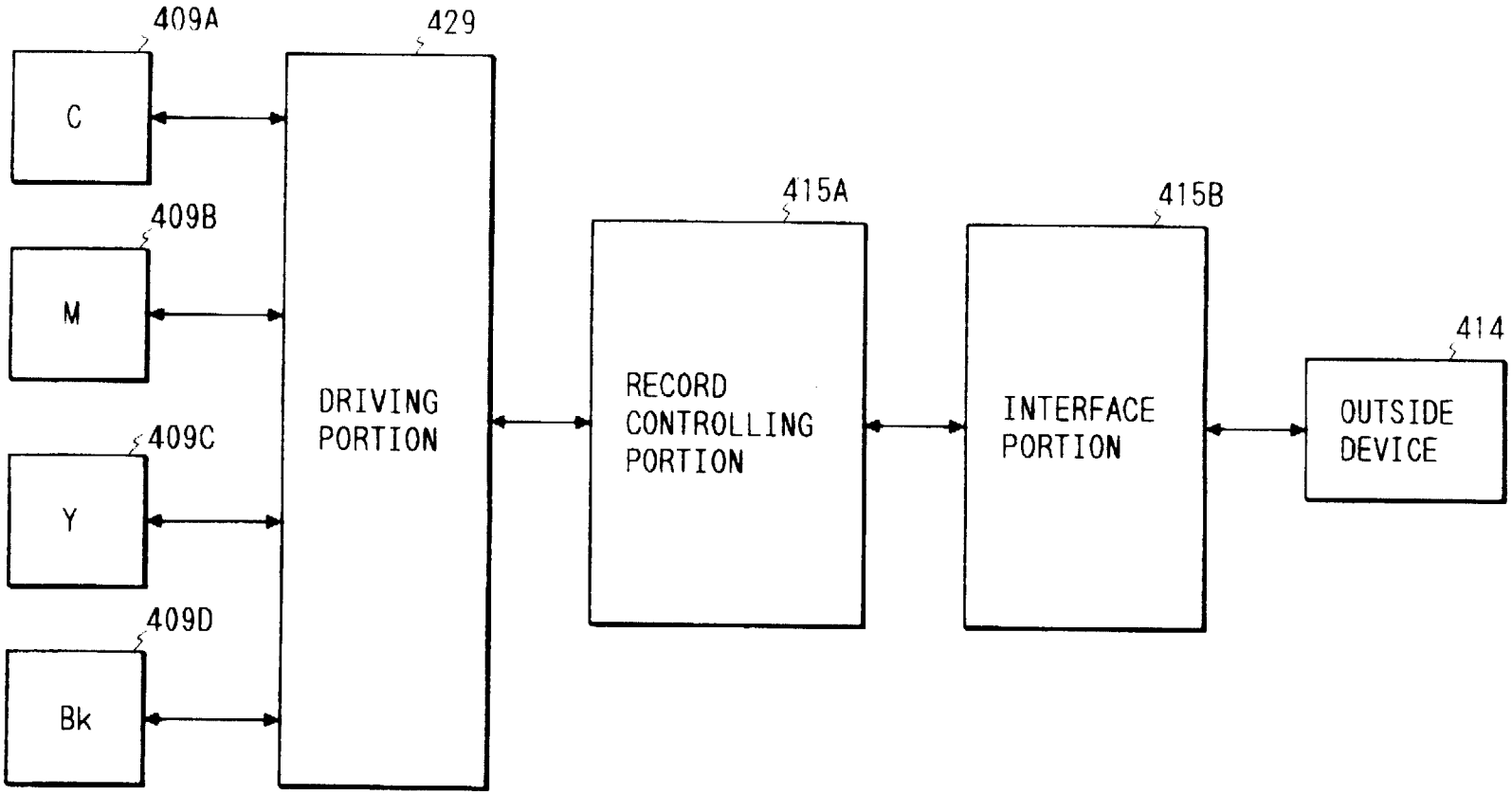
FIG. 22 is a block diagram showing a construction of a control system of the recording system.

FIG. 22 schematically shows a control system for the ink jet recording system of FIG. 19. The reference numeral 415A denotes a record controlling portion disposed on the control substrate 415 and adapted to perform the recording operation while effecting the control for various portions of the recording system; and 415B denotes an interface portion for sending and receiving various signals between it and the outside host device. The record controlling portion 415A may be in the form of a microcomputer comprising a CPU for performing the control operation, a ROM storing a program including the control sequencer a RAM having a recording data developing area and a working area, and the like. Further, in the illustrated embodiment, a central portion of an environmental condition measuring apparatus (described later with reference to FIG. 23) is integrally incorporated in the recording system.

Figure 23:
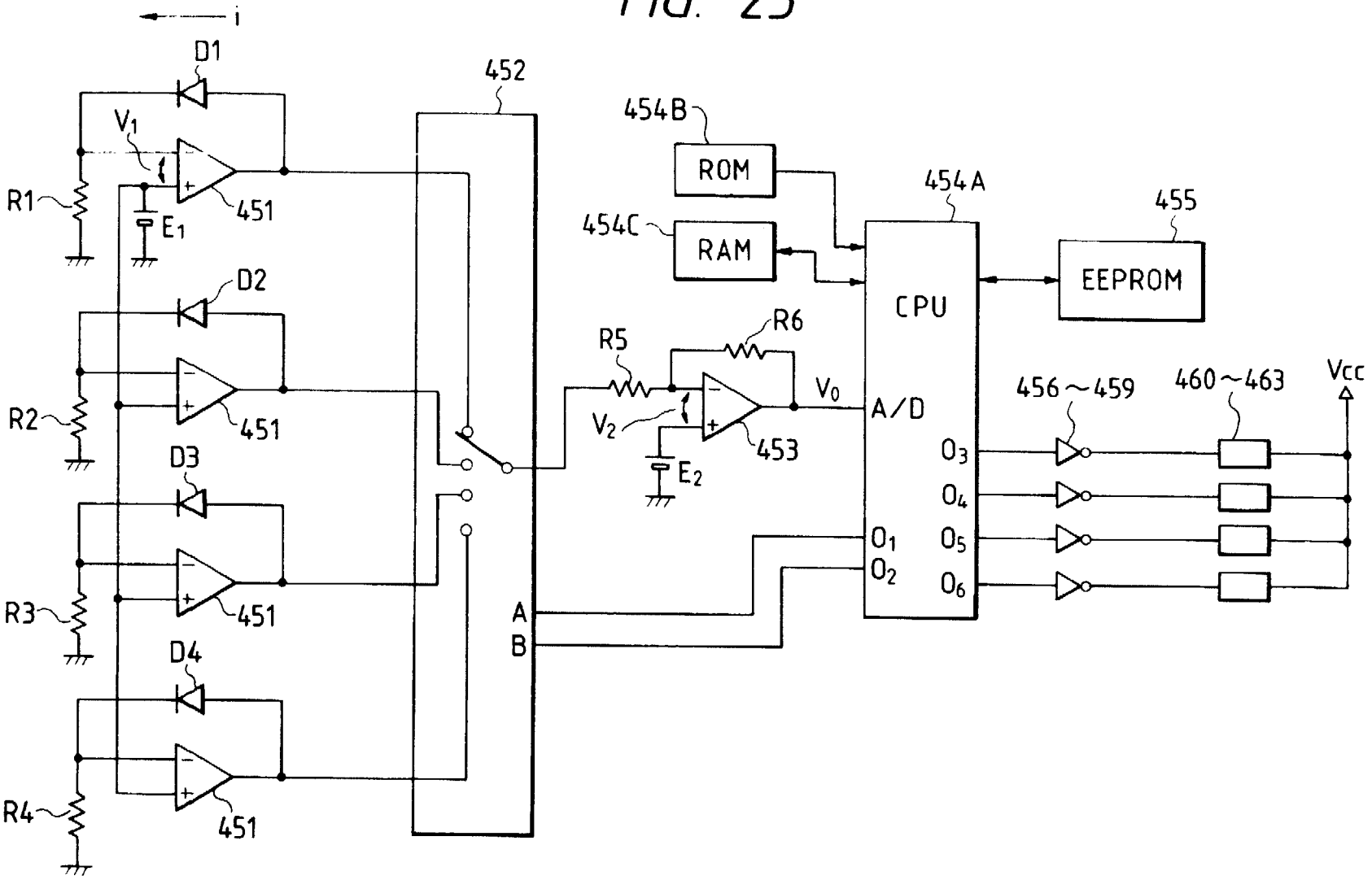
FIG. 23 is a circuit diagram applied to the construction of FIG. 22, according to an embodiment of the present invention.

FIG. 23 shows an example that a temperature adjusting apparatus is integrally incorporated into the record controlling portion.

The reference numerals D1–D4 denote temperature sensors 402 (in this example, diodes) disposed on the recording heads 409A–409D; 451 denotes amplifiers each having a constant current circuit; 452 denotes an analogue switch which can select one of the outputs of the amplifiers 451 on the basis of control signals A, B; and 453 denotes an amplifier for receiving the output of the analogue switch.

The reference numeral 454A denotes a CPU constituting a main controlling portion of the recording system according to this example and adapted to perform the correction data storing operation and the measuring operation in accordance with a predetermined sequence which will be described later with reference to FIGS. 24 and 26; 454B denotes a ROM for storing the program including such sequence and other given data; and 454C denotes a RAM having a data developing area and a working area. The reference numeral 455 denotes a nonvolatile memory, for example, in the form of EEPROM; 460–463 denote heat keeping heaters (448) arranged on the heater boards of the recording heads 409A 409D; and 456–459 denote drivers for the heat keeping heaters.

Incidentally, in FIG. 23, while one diode as the temperature sensor was shown for each recording head, of course, as the example shown in FIG. 21, two diodes may be used for each recording head. Even if the number of the detecting sensors (diodes) is increased as such, this embodiment can effectively cope with such increase of the sensors, as apparent from the following description.

In the illustrated embodiment, the diodes are used as the temperature sensors, and the temperature is detected by the use of the temperature feature of the diode forward voltage reduction $V_F$. The amplifiers 451 are the constant current circuits, and thus, the constant current $i=E_1/R_1$ flows in the diode. Of course, to arrange or adjust the conditions, the following equation should be met: $R_1=R_2=R_3=R_4$. The output selected by the analogue switch 452 on the basis of the control signals A, B is compared with the reference voltage in the amplifier 453, and the voltage difference is multiplied by $R_6/R_5$ to obtain the output of the amplifier 453. That is to say, the output V0 of the amplifier 453 can be expressed by the following equation:

$$\begin{aligned} V0 &= E_2 - \{(E_1 + V_F) - E_2\} \times (R_6/R_5) \\ &= \{E_2 - (E_1 - E_2) \cdot (R_6/R_5)\} - V_F \cdot (R_6/R_5) \\ &= C_0 + A \cdot V_F \end{aligned} \quad (1)$$

(where, $C_0=E_2-(E_1-E_2)\cdot(R_6/R_5)$; $A=-(R_6/R_5)$). Thus, it is found that the output V0 is a function of the voltage $V_F$ of the temperature sensor.

However, in effect, the amplifiers 451, 453 are not ideal amplifiers and include input offset voltages and the like, and thus, the influence of these amplifiers upon the final output V0 cannot be negligible. Now, when the input offset voltage of the amplifier 451 is $V_1$ and the input offset voltage of the amplifier 453 is $V_2$, the equation (1) is rewritten to:

$$\begin{aligned} V0 &= (E_2 + V_2) - (E_1 + V_F + V_1) - \\ &\quad (E_2 + V_2)\} \cdot (R_6/R_5) \\ &= \{E_2 - (E_1 - E_2) \cdot (R_6/R_5)\} + V_2 - \\ &\quad (V_1 - V_2) \cdot (R_6/R_5) - V_F \cdot (R_6/R_5) \\ &= C_0 + A \cdot V_F + V_2 + A \cdot (V_1 - V_2) \\ &= C_1 + A \cdot V_F \end{aligned} \quad (2)$$

(where, $C_1=C_0+V_2A(V_2-V_1)$). Thus, the output $V_0$ is influenced upon the offset voltages $V_1$, $V_2$. Further, in FIG. 23, since the analogue switch is used, the output V0 is also influenced upon the voltage reduction in this switch.

Accordingly, in FIG. 23, if the voltage reductions in the diodes D1–D4 are the same, the values of the output V0 are different from each other, and accordingly, it is inconvenient that a certain value of the output V0 corresponds to a given temperature unconditionally.

In the illustrated embodiment, in consideration of the above fact, the following method is adopted for correcting the output V0 of the amplifier to detect the correct temperature.

Figure 24:
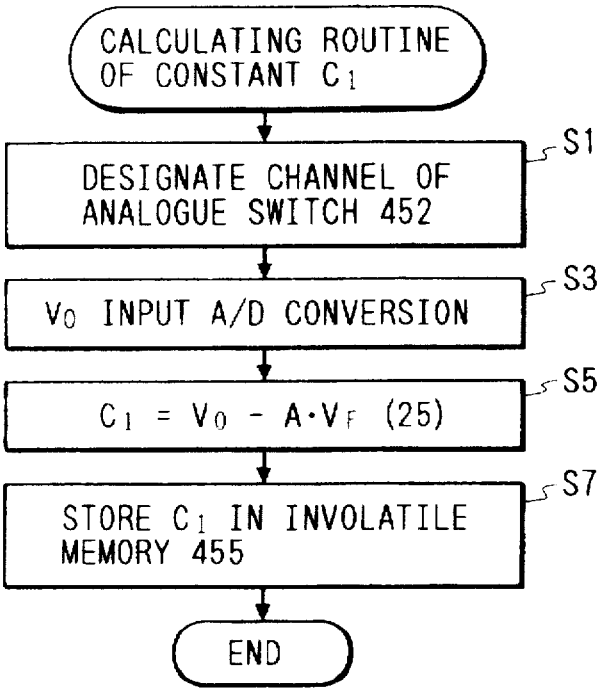
FIG. 24 is a flowchart showing an example of a correction data detecting procedure by means of the circuit of FIG. 23.

FIG. 24 shows an example of the procedure for obtaining the correction data, which correction can be carried out at the manufacturing stage or maintenance stage of the recording system. From the equation (2), $$V0=C_1+A\cdot V_F(T)$$

is obtained. Since the $C_1$ is a constant having different values in the respective circuits, A is a fixed constant, and $V_{F(T)}$ is a function of the temperature, in order to seek the value $C_1$ first, the voltage reduction corresponding to the value $V_F$ at for example 25° C. is created at a portion corresponding to Dn ($1 \leqq n \leqq 4$), and the obtained values V0 are all A/D-converted by the CPU 454A (step S1, S3).

Then, on the basis of the equation (2), for each circuit, the following equation is calculated to seek the value $C_1$ (step S5):

$$C_1 = V0 - A \cdot V_F(T) \tag{3}$$

The obtained values $C_1$ are stored in the nonvolatile memory 455 (for example, EEPROM and the like) (step S7). As a result, when the output V0 is detected, from the equation (3), the following equation (4) is derived, and thus, the value $A \cdot V_F(T)$ can be obtained:

$$A \cdot V_F(T) = V0 - C_1 \tag{4}$$

Figure 25:
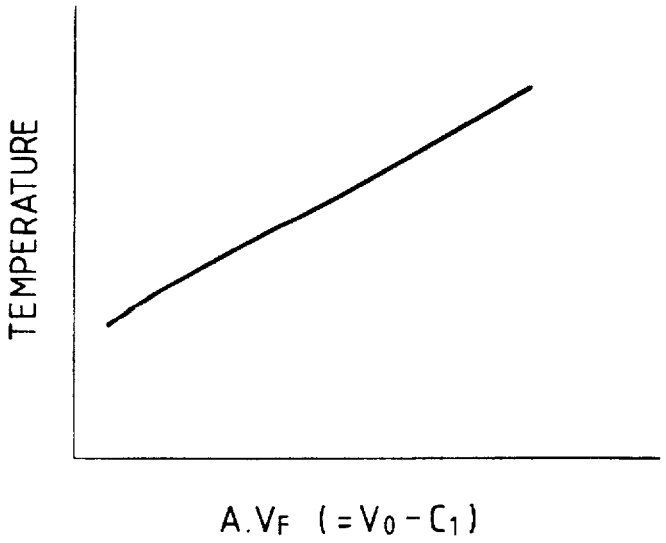
FIG. 25 is a graph showing the relationship between the correction data and the temperature.

Thus, the temperature T can be easily sought from the previously determined relationship between the temperature T and the value $A \cdot V_F(T)$ as shown in FIG. 25.

In this way, when the temperature of each head is sought, by independently ON/OFF controlling the heat keeping heaters 410–413 arranged in the respective heads 409A, 409B, 409C, 409D corresponding to C ink, M ink, Y ink, BK ink (FIG. 22), it is possible to correctly control the head temperature at the desired temperature.

Figure 26:
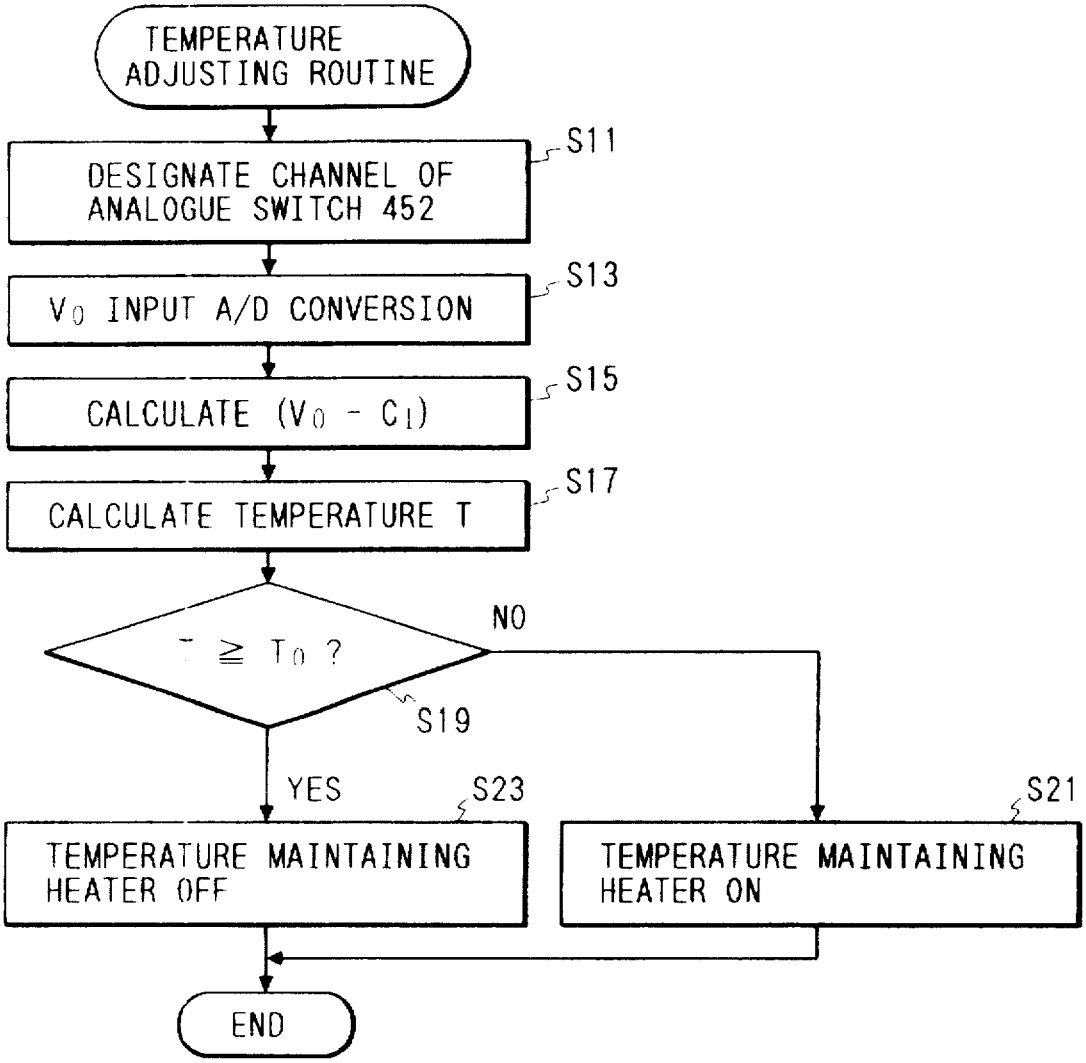
FIG. 26 is a flowchart showing an example of a temperature measuring and temperature controlling procedure by means of the circuit of FIG. 23.

FIG. 26 shows an example of the head temperature controlling procedure for the recording head of FIG. 23.

When this procedure or sequence is initiated, first of all, the channel of the analogue switch 452 is designated by an output $\mathbf{0}_1$ or $\mathbf{0}_2$ (step S11). Then, the output value V0 regarding the selected recording head is A/D-converted (step S13), and then, by using this value V0 and the constant $C_1$ previously stored in the non-volatile memory 455, ($V0-C_1$) is calculated (step S15). Next, on the basis of this result ($V0-C_1$), the temperature T is calculated in accordance with the relation shown in FIG. 25 or is sought by referring to the table (step S17). By comparing the obtained temperature T with the control temperature T0 (step S19), the heat keeping heaters (i.e., temperature maintaining heaters) in each recording head are on/off controlled (step S21, S23). In this way, since the head temperature of each recording head is automatically adjusted during the operation thereof by the temperature adjusting apparatus according to this embodiment, the dispersion in the density, dispersion in the ink discharging speeds, dispersion in ink droplet reaching points and the like are considerably reduced, thus permitting the formation of good image.

Embodiment 3

In the above second embodiment, an example that the temperature features of the diodes used to the temperature sensors are uniform was explained.

This example is useful in a case where the heater boards are obtained from the wafer of the same lot, since there is substantially no dispersion of the features of the diodes thereof. However, in effect, is since there is the dispersion between the lots, in this third embodiment, such dispersion is also corrected.

Figure 27:
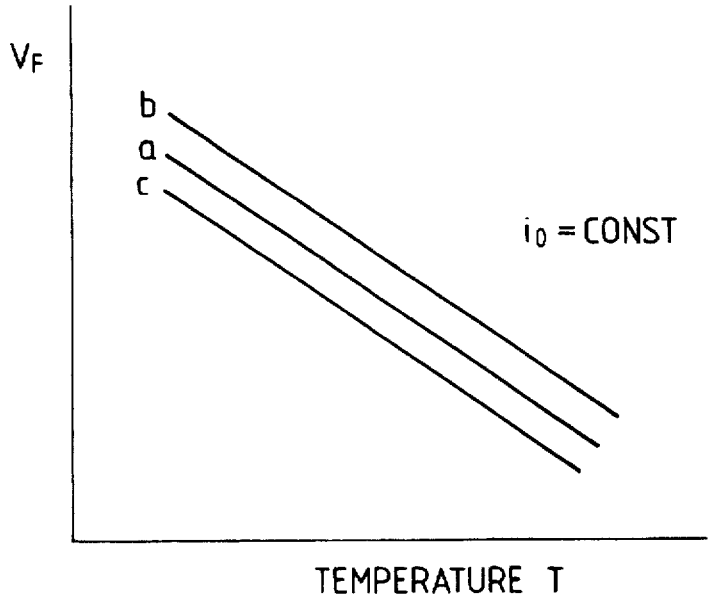
FIG. 27 is a graph for explaining the dispersion in the temperature features of the sensors.

When there is the dispersion in the values $V_F(T)$ for a predetermined temperature T, various values of V0 regarding the equation (2) (i.e., $V0 = C_1 + A \cdot V_F(T)$) at the predetermined temperature would be obtained. However, the temperature feature of the diode has a characteristic that the changing rate thereof is constant, although the voltage reduction $V_F$ thereof varies in a certain range in accordance with the temperature T, when the constant current flows in the diode, as shown in FIG. 27. Accordingly, when the standard feature of the diode is shown by a curve or line a, there arises the following relationship between the standard feature and a feature other than a:

$$V_F'(T) - V_F(T) = \text{const.} \tag{5}$$

Where, $V_F'(T)$ is, for example, a temperature feature of the diode having the feature as shown by the line b in FIG. 27. Thus, the difference between the line b and the line a is constant through all of the temperature range.

Now, the constant $C_1$ inherent to the circuit in the equation (2) is sought in the same manner as in the case of the above second embodiment, and is stored in the non-volatile memory 455.

Further, a means for judging or discriminating the $V_F$ feature inherent to the diode is also provided in each recording head. Such means may include an additional non-volatile memory arranged in the recording head, which can store the necessary information and from which the information can read out as needed.

Figure 28:
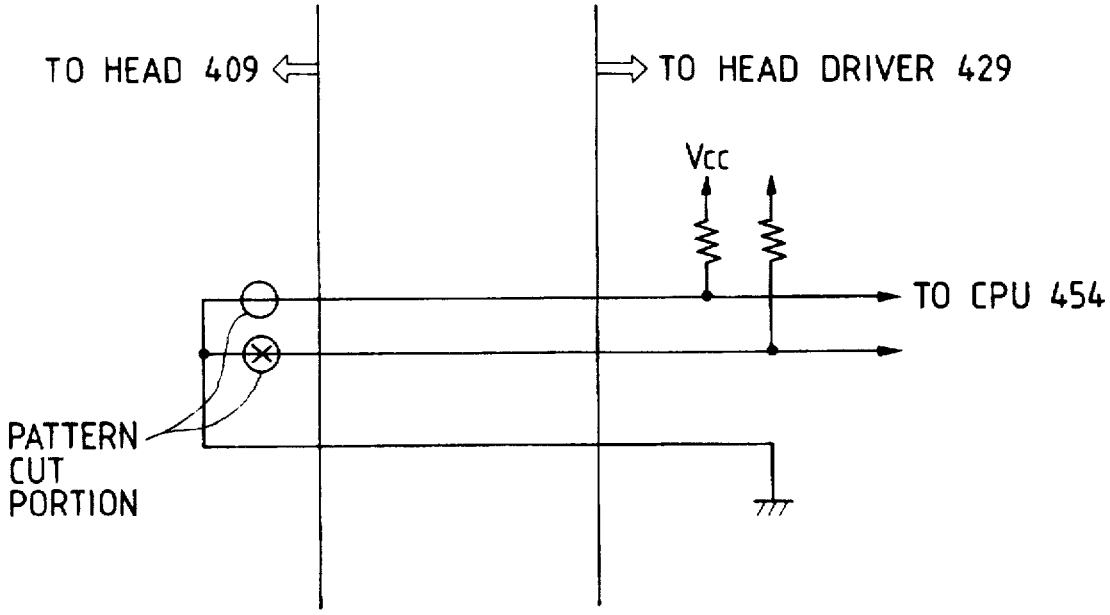
FIG. 28 is an explanatory view showing a 1construction available to discriminate the dispersion of the sensors.

Alternatively, as shown in FIG. 28, a pattern capable of having the judging information of a few bits (two bits in the illustrated example) is formed on the heater board, and, when the dispersion in the features of the diode sensors is checked, two-bit information may be obtained by cutting or short-circuiting the pattern of the recording head side.

In consideration of the above, it is assumed that, when a certain recording head is connected to the circuit shown in FIG. 23, the recording head shows the following feature:

$$V0' = C_1 + A \cdot V_F'(T) \tag{6}$$

(Incidentally, the value $C_1$ has already been determined and stored in the non-volatile memory 455.)

Now, in order to know the present temperature of this recording head, it is necessary to clarify the relationship between this temperature and the standard feature (line a in FIG. 27). If the diode has the standard feature, the equation (6) is expressed by:

$$V0 = C_1 + A \cdot V_F'(T) \tag{7}$$

From the equations (6) and (7), the following relation can be derived:

$$V0' - V0 = A\{V_F'(T) - V_F(T)\} \tag{8}$$

Now, from the equation (5), it is found that the value in { } in the equation (8) is constant, and, since this value can be known by the means shown in FIG. 28, the right term of the equation (8) can be calculated by the CPU 454A. Thus, $$V0 = V0' - A\{V_F'(T) - V_F(T)\} \tag{9}$$

is calculated, and the value V0' can correspond to the value V0 in the case of the standard feature. When the value V0 is sought, similar to the second embodiment, the temperature T is sought by utilizing the relation shown in FIG. 25, and the proper head temperature control can be performed.

Figure 29:
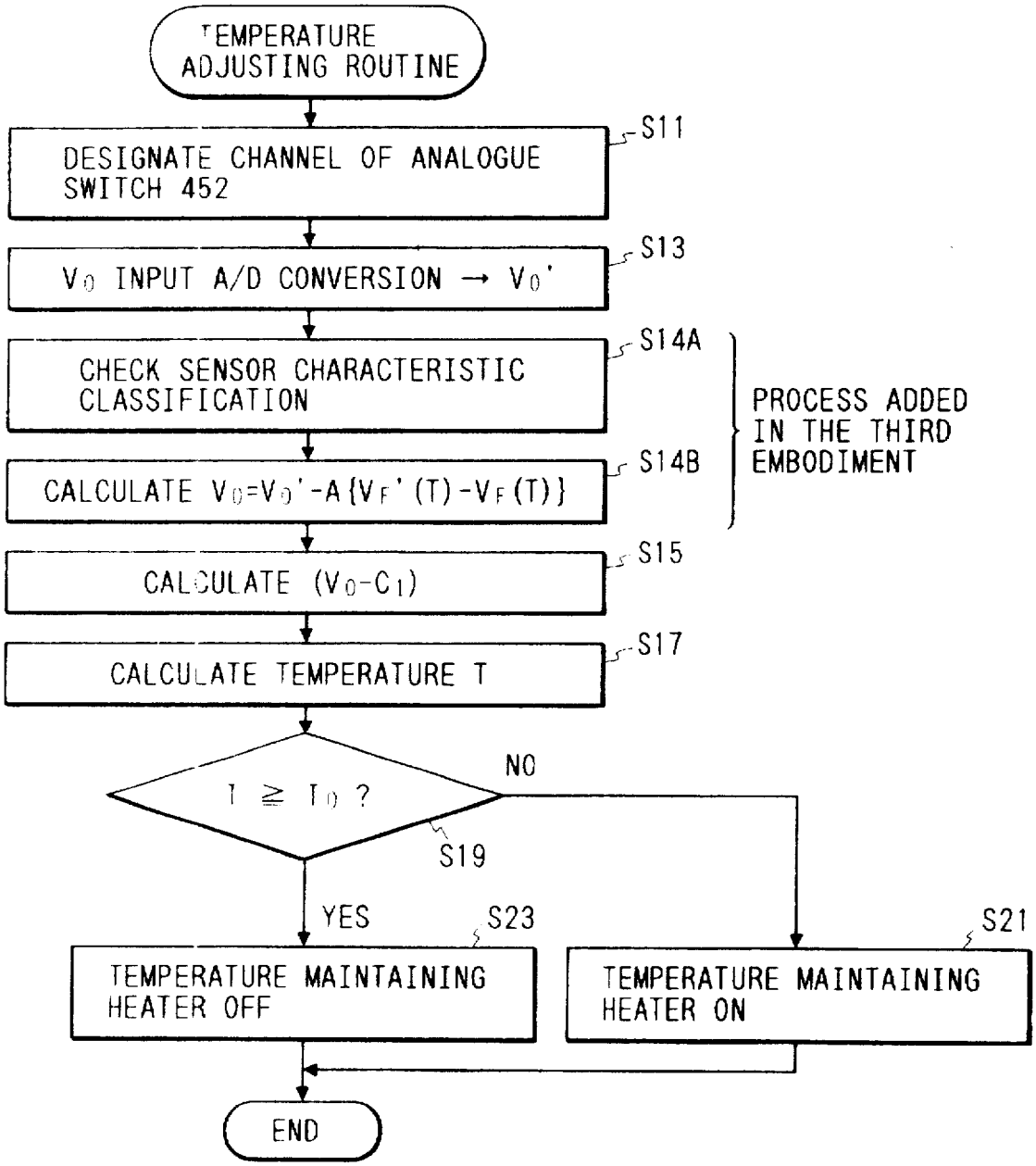
FIG. 29 is a flow chart showing an example of a temperature measuring and temperature controlling procedure in consideration of the dispersion in the sensors.

FIG. 29 shows a control sequence in this third embodiment. In this example, between the step S13 and the step S15 in the sequence shown in FIG. 26, a process for classifying and judging the sensor information (step S14A) and a process for calculating the value V0 on the basis of such information and the circuit feature (step S14B) are inserted.

Embodiment 4

An example that the resistor sensors 442 shown in FIGS. 21A and 21B are used as the temperature sensors will be described.

Figure 30:
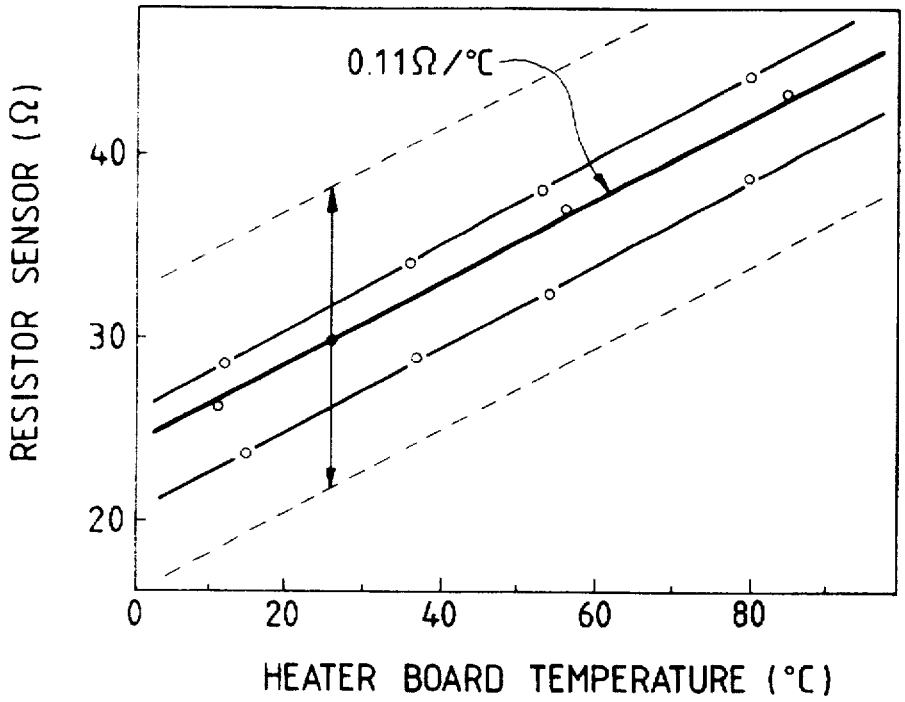
FIG. 30 is a graph for explaining the temperature feature of a resistor available to the temperature sensor.

As shown in FIG. 30, the resistor sensor has a feature that the resistance value thereof increases as the temperature is increased. Also in this case, as in the case of the diode, there arises the dispersion in the features. The relationship between the temperature T and the resistance value R is given by the following equation:

$$R(T)=R0+\alpha\cdot R0(T-T0)=R0\{1+\alpha\cdot(T-T0)\} \quad (10)$$

Where, R is the resistance value [Ω] at 25° C., T0 is 25[°C.], and a is a temperature coefficiency inherent to the resistor [1/°C]. When this resistor is used as the sensor, the detection output V0 thereof is expressed by the following relation, from the equation (2):

$$V0=C_1+A\cdot i_o R(T). \quad (11)$$

Also in this case, as in the case of the second embodiment, first of all, the constant $C_1$ inherent to the circuit is calculated by using the reference resistance R0 as a reference value for this sensor and by A/D converting the value V0 at that time, and the calculated value $C_1$ is stored in the non-volatile memory 455.

Further, also in this fourth embodiment, in consideration of the difference r from the reference value R0 at 25° C. in response to the dispersion in the features of the sensors, it is possible to obtain the information, for example, in the same manner as that shown in FIG. 28. In this case, the equation (10) can be rewritten as follows:

$$R'(T)=(R0+r)\cdot\{1+\alpha\cdot(T-T0)\} \quad (12)$$

Accordingly, the detection output V0 obtained when the sensor having the feature R' is used becomes as follows:

$$\begin{aligned} V(R') &= C_1+Ai_0R'(T) \quad (13)\\ &= C_1+Ai_0\{(R0+r)(1-\alpha T0)+\alpha T(R0+r)\}\\ &= C_2+Ai_0\alpha T(R0+r) \end{aligned}$$

(where, $C_2=C_1+Ai_o(R0+r)(1-\alpha T0)$).

From this, the temperature t is sought in accordance with the procedure shown in FIG. 29, and thus, the proper temperature control can be performed.

Embodiment 5

The environmental condition may be, for example, a humidity affecting an influence upon the viscosity of the ink. In this case, for example, in FIG. 23, in place of the temperature sensors, humidity sensors may be used, but the other elements are the same as those shown in FIG. 23. Also in this case, the temperature control can be performed in the same manner as described above. Further, various kinds of sensors may be used in combination.

Incidentally, when the present invention is applied to the ink jet recording system, the present invention gives excellent advantages, particularly, in the bubble jet recording head and bubble jet recording system, for the reason that, since the thermal energy is used as an energy for effecting the recording in the bubble jet recording system, the control can be performed in response to the environmental condition (temperature) in consideration of the heat of the recording system.

Preferably, the typical construction and principle thereof can be realized by using the fundamental principles, for example, disclosed in U.S. Pat. Nos. 4,723,129 and 5,740,796. Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding the nucleate boiling to the electrical/thermal converting elements arranged in the sheets or liquid passages including the liquid (ink) therein, it is possible to form a bubble in the liquid (ink) in corresponding to the drive signal by generating the film boiling on the heat acting surface of the recording head due to the generation of the thermal energy in the electrical/thermal converting elements. Due to the growth and contraction of the bubble, the liquid (ink) is discharged from the discharge opening to form at least one ink droplet.

When the drive signal has a pulse shape, since the growth and contraction of the bubble can be quickly effected, a more excellent ink operation can be achieved. Such pulse-shaped drive signal may be types disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid paths and electrical/thermal converting elements are combined (straight liquid paths or orthogonal liquid paths). In addition, the present invention can applicable to the construction wherein each discharge opening is constituted by a slit with which a plurality of electrical/thermal converting elements associated in common as disclosed in the Japanese Patent Laid-Open No. 59-123670 and the construction wherein openings for absorbing the pressure wave of the thermal energy are arranged in correspondence to the discharge openings as disclosed in the Japanese Patent Laid-Open No. 59-138461, because the recording can be correctly and effectively performed regardless of the configuration of the recording head.

Further, the present invention can be applied to a recording head of full-line type having a length corresponding to a maximum width of a recording medium to be recorded, as such recording head, the construction wherein such length is attained by combining a plurality of recording heads or a single recording head integrally formed may be adopted. In addition, among the above-mentioned serial types, the present invention is effectively applicable to a removable recording head of chip type wherein, when mounted on the recording system, electrical connection between it and the recording system and the supply of ink from the recording system can be permitted, or to a recording head of cartridge type wherein a cartridge is integrally formed with the head.

Further, as to the kind and number of the recording head to be mounted, each recording head may correspond to each different color ink, or a plurality of recording heads can be used for a plurality of ink having different colors and/or different density.

Furthermore, the recording system according to the present invention may be in the form of an image output terminal device for an information processing apparatus such as a computer, or a copying machine combined with a reader, or a facsimile having the sending and receiving functions.

Lastly, the recording system to which the temperature adjusting apparatus of the present invention is applicable may not only the above-mentioned ink jet recording system, but also any ink jet recording systems other than the above type, or other recording system such as a thermal printer and the like.

As mentioned above, according to the present invention, since the pattern acting as the information bearing means for carrying the information providing the features of the temperature detecting elements is previously arranged on the recording head, it is possible to correct the dispersion in the features of the temperature detecting elements obtained by the semiconductor process with a very simple method and arrangement, and to perform the proper temperature control.

Further, according to the present invention, by previously setting the reference value as the detection output of the element and, by storing such detection output or the result obtained by effecting the predetermined calculation by using such detection output in the memory means, since the error of the detecting elements being used can be corrected on the basis of the contents stored in the memory means when the temperature adjustment is effected in accordance with environmental condition, it is possible to obtain the high accurate measurement result without adjusting the output voltage level regarding the rated error of the detecting element and/or the offset voltage of the amplifying circuit, and to reduce the number of adjustments in the mass-production line.

Further, even when the detecting elements is one of consumption parts, it is not necessary to perform the level adjustment during the exchange of the consumption parts.

In addition, since the head temperature adjustment during the operation is automatically effected for each recording head by means of the temperature adjusting apparatus according to the present invention, the dispersion in the density, the dispersion in the ink discharging speeds and the dispersion in the ink reaching points can be considerably reduced, thus permitting the formation of the high quality image.

What is claimed is:

1. An ink jet recording apparatus, comprising:

a recording head comprising an ejection outlet for ejecting an ink, an energy generating element disposed proximate to the ejection outlet for generating energy to eject the ink, a temperature detecting element for detecting a temperature in said recording head, and a semiconductor memory means for storing an information relating to an output characteristic of said temperature detecting element;

a main body of said ink let recording apparatus on which said recording head is removably mounted, said main bodv including mounting means for removably mounting said recording head, transmitting means for transmitting an output of the temperature detected by said temperature detecting element and the information stored in said semiconductor memory means from the recording head in a state where said recording head is mounted onto said mounting means correcting means for correcting the output of said temperature detecting element transmitted from said recording head by said transmitting means according to the information stored in said semiconductor memory means and transmitted from said recording head by said transmitting means and control means for controlling a thermal energy generating state of said recording head according to the output corrected by said correcting means.

2. An ink jet recording apparatus according to claim 1, said recording head further comprising at least one of a temperature adjusting heater therein, and wherein said controlling means controls operation of said heater according to the output corrected by said correcting means.

3. An ink jet recording apparatus according to claim 1 or 2, said semiconductor memory means comprising a non-volatile memory.

4. An ink jet recording apparatus according to claim 1 or 2, said temperature detecting element comprising a diode.

5. An ink jet recording apparatus according to claim 1, wherein said diode is formed on a substrate on which said energy generating element is formed in a same process as said energy generating element.

6. An ink jet recording apparatus according to claim 1 or 2, wherein said recording head is detachably mounted onto said mounting means.

7. An ink jet recording apparatus according to claim 1 or 2, said recording head further comprising an ink storage portion for storing the ink.

8. An ink jet recording apparatus according to claim 1 or 2, said energy generating element comprising an electrothermal converting member for generating thermal energy to be used for causing a change in a state of the ink to thereby discharge the ink from the ejection outlet.

9. An ink jet recording apparatus according to claim 1 or 2, further comprising a plurality of said recording heads, said plural recording heads being used to record respectively inks of different colors.

10. An ink jet recording head removably mounted onto a main body of an ink jet recording apparatus, comprising:

an ejection outlet for ejecting an ink;

an energy generating element disposed proximate to said ejection outlet for generating energy to eject the ink from the ejection outlet;

a temperature detecting element for detecting a temperature in said recording head; and a semiconductor memory for storing an information relating to an output characteristic of said temperature detecting element, wherein an output of the temperature detected by said temperature detecting element and the information stored in said semiconductor memory are transmitted to the main body of said ink jet recording apparatus having a correcting means for correcting the output of said temperature detecting element, so that the output from said temperature detecting element is to be corrected corresponding to the information in said semiconductor memory by said correcting means.

11. An ink jet recording head according to claim 10, further comprising a temperature adjusting heater for adjusting a temperature of said recording head.

12. An ink jet recording apparatus according to claim 10 or 11, said semiconductor memory means comprising a non-volatile memory.

13. An ink jet recording apparatus according to claim 10 or 11, said temperature detecting element comprising a diode.

14. An ink jet recording apparatus according to claim 13, wherein said diode is formed on a substrate on which said energy generating element is formed in a same process as said energy generating element.

15. An ink jet recording apparatus according to claim 10 or 11, said recording head further comprising an ink storage portion for storing the ink.

16. An ink jet recording apparatus according to claim 10 or 11, said energy generating element comprising an electrothermal converting member for generating thermal energy to be used for causing a change in a state of the ink to thereby discharge the ink from the ejection outlet.

17. An ink jet recording apparatus according to claim 10 or 11, further comprising a plurality of said recording heads, said plural recording heads being used to record respectively inks of different colors.

18. An ink jet recording apparatus, comprising:

a recording head for recording an image on a recording sheet by discharging an ink corresponding to an input signal, said recording head including a temperature detecting element for detecting a temperature of said recording head and a semiconductor memory means for storing an information relating to an output characteristic of said temperature detecting element; and a main body of said ink let recording apparatus on which said recording head is removably mounted, said main body including mounting means for removably mounting said recording head, transmission means for transmitting an output signal of said temperature detecting element and the information stored in said semiconductor memory means from said recording head, correcting means for correcting the output of said temperature detecting element transmitted from said recording head by said transmission means according to the information stored in said semiconductor memory means and is transmitted from said recording head by said transmission means, and control means for controlling a thermal energy generating state of said recording head according to an output corrected by said correcting means.

19. An ink jet recording apparatus according to claim 18, said transmission means comprising an amplifier, and wherein the information is used for correcting an output of said amplifier.

20. An ink jet recording apparatus according to claim 18, said recording head comprising a temperature adjusting heater therein, and wherein said controlling means controls operation of said heater according to the output corrected by said correcting means.

21. An ink jet recording apparatus according to claim 18, wherein said semiconductor memory means comprises a non-volatile memory.

22. An ink jet recording apparatus according to one of claims 18 to 20, said temperature detecting element comprising a diode.

23. An ink jet recording apparatus according to claim 22, wherein said diode is formed on a substrate on which said energy generating element is formed in a same process as said energy generating element.

24. An ink jet recording apparatus according to one of claims 18–21, further comprising mount means for mounting said recording head, said recording head being detachably mounted onto said mounting means.

25. An ink jet recording apparatus according to one of claims 18–21 said recording head comprising an ink storage portion for storing the ink.

26. An ink jet recording apparatus according to one of claims 18–21, said energy generating element comprising an electro-thermal converting member for generating thermal energy to be used for causing a change in a state of the ink to thereby discharge the ink from a discharge opening.

27. An ink jet recording apparatus according to one of claims 18–21, further comprising a plurality of said recording heads, said plural recording heads being used to record respectively inks of different colors.

* * * * *

UNITED STATES PATENT AND TRADEMARK OFFICE

CERTIFICATE OF CORRECTION

PATENT NO. : 5,760,797

DATED : June 2, 1998

INVENTOR(S) : RYOICHI KOIZUMI, ET AL.

It is certified that error appears in the above-identified patent and that said Letters Patent is hereby corrected as shown below:

AT [57] ABSTRACT

Line 9, "are" should read --is--.

COLUMN 1

Line 50, "is a" should read --is--; and
Line 62, "substrate 8" should read --substrates--.

COLUMN 2

Line 7, "the-" should read --the--;
Line 11, "affects" should read --effects--;
Line 33, "semi-conductor" should read --semiconductor--;
Line 40, "line" should read --line,--; and
Line 47, "the" should be deleted.

COLUMN 3

Line 39, "a" should be deleted; and
Line 40, "numerals" should read --numeral--.

COLUMN 4

Line 40, "stored-in" should read --stored in--; and
Line 48, "the" should be deleted.

COLUMN 5

Line 6, "view" should read --views--.

UNITED STATES PATENT AND TRADEMARK OFFICE

CERTIFICATE OF CORRECTION

PATENT NO. : 5,760,797

DATED : June 2, 1998

INVENTOR(S) : RYOICHI KOIZUMI, ET AL.

It is certified that error appears in the above-identified patent and that said Letters Patent is hereby corrected as shown below:

COLUMN 6

Line 3, "1construction" should read --construction--;
Line 5, "flow chart" should read --flowchart--;
Line 29, "voltages." should read --voltage.--; and
Line 61, "values" should read --value--.

COLUMN 7

Line 4, "the" should be deleted;
Line 48, "is" should be deleted;
Line 55, "s0" should read --so--; and
Line 67, "heating" should read --the heating--.

COLUMN 8

Line 2, "member" should read --members--;
Line 8, "pats" should read --patterns--;
Line 30, "pats" should read --patterns--;
Line 58, "and" should read --and is--;
Line 59, "heater" should read --member--;
Line 62, "heater" should read --member--; and
Line 63, "Iused" should read --used--.

COLUMN 9

Line 12, "the fine" should read --fine--;
Line 36, "the high" should read --high--; and
Line 63, "canitation" should read --cavitation--.

UNITED STATES PATENT AND TRADEMARK OFFICE

CERTIFICATE OF CORRECTION

PATENT NO. : 5,760,797

DATED : June 2, 1998

INVENTOR(S) : RYOICHI KOIZUMI, ET AL.

It is certified that error appears in the above-identified patent and that said Letters Patent is hereby corrected as shown below:

COLUMN 10

Line 23, "by" should read --by a--;
Line 57, "the" should be deleted; and
Line 59, "the" should be deleted.

COLUMN 11

Line 6, "is." should read --is--;
Line 20, "12C). (10)" should read --12C). ¶ (10)--;
Line 27, "spattering" should read --sputtering--;
Line 43, "canitation" should read --cavitation--; and
Line 54, "protrude" should read --protrudes--.

COLUMN 13

Line 21, "are" should read --is--;
Line 24, "IT The" should read --IT ¶ The--;
Line 39, "include," should read --includes--;
Line 55, "to the" should read --the--; and
Line 56, "air existing space than" should read --existing air space from--.

COLUMN 14

Line 7, "However, the" should read --However, if the--;
Line 30, "equals" should read --is equal--;
Line 31, "head" should read --head.--;
Line 32, "17)." should read --17.)--;
Line 34, "(through-" should read --(through--; and
Line 55, "the" should be deleted.

UNITED STATES PATENT AND TRADEMARK OFFICE

CERTIFICATE OF CORRECTION

PATENT NO. : 5,760,797

DATED : June 2, 1998

INVENTOR(S) : RYOICHI KOIZUMI, ET AL.

It is certified that error appears in the above-identified patent and that said Letters Patent is hereby corrected as shown below:

COLUMN 15

Lines 5-6, "space. ¶ However," should read --space. However,--;
Line 33, "integrally" should read --integrally and--;
Line 39, "the masspro-" should read --a mass pro- --;
Line 47, "a upward" should read --an upward--;
Line 59, "surfaces" should read --surface--; and
Line 63, "surfaces" should read --surface--.

COLUMN 16

Line 21, "more" should read --better--;
Line 22, "pats" should read --patterns--;
Line 29, "patterns." should read --of the patterns.--;
Line 34, "can-be" should read --can be--;
Line 58, "jet." should read --jet--;
Line 60, "is a" should read --a--; and
Line 63, "s0" should read --so--.

COLUMN 17

Line 14, "in synchronous" should read --synchronously--; and
Line 43, "pair" should read --pairs--.

COLUMN 18

Line 2, "is" should be deleted;
Line 42, "respectively" should read --, respectively,--;
Line 49, "as same" should read --the same--;
Line 56, "the" should be deleted;
Line 63, "electrode" should read --electrodes--; and
Line 66, "canitation" should read --cavitation--.

UNITED STATES PATENT AND TRADEMARK OFFICE

CERTIFICATE OF CORRECTION

PATENT NO. : 5,760,797

DATED : June 2, 1998

INVENTOR(S) : RYOICHI KOIZUMI, ET AL.

It is certified that error appears in the above-identified patent and that said Letters Patent is hereby corrected as shown below:

COLUMN 19

Line 19, "441,." should read --441,--; and
Line 65, "409A" should read --409A- --.

COLUMN 20

Line 36, "-($E_1$" should read -- -{($E_1$--; and
Line 65, "$V_{F(T)}$" should read --$V_F$(T)--.

COLUMN 21

Line 23, "ON/OFF" should read --on/off--;
Line 41, "heaters" should read --members--; and
Line 53-54, "explained. ¶ This" should read --explained. This--.

COLUMN 22

Line 4, "than a:" should read --than that shown by line a:--.

COLUMN 24

Line 21, "ink" should read --ink discharge--; and
Line 34, "can" should read --can be--.

UNITED STATES PATENT AND TRADEMARK OFFICE

CERTIFICATE OF CORRECTION

PATENT NO. : 5,760,797

DATED : June 2, 1998

INVENTOR(S) : RYOICHI KOIZUMI, ET AL.

It is certified that error appears in the above-identified patent and that said Letters Patent is hereby corrected as shown below:

COLUMN 25

Line 3, "not only" should read --not be only--;
Line 21, "envi-" should read --the envi- --;
Line 22, "the high" should read --highly accurate--;
Line 23, "result" should read --results--;
Line 27, "is one of" should read --is one of the--;
Line 49, "let" should read --jet--;
Line 51, "bodv" should read --body--;
Line 57, "means" (first occurrence) should read --means,--; and
Line 62, "means" should read --means,--.

COLUMN 28

Line 22, "18-21" should read --18-21,--.

Signed and Sealed this

Thirtieth Day of March, 1999

*Attest:*

*Attesting Officer*

Q. TODD DICKINSON

*Acting Commissioner of Patents and Trademarks*